US007455879B2

(12) United States Patent
Iguchi et al.

(10) Patent No.: US 7,455,879 B2
(45) Date of Patent: Nov. 25, 2008

(54) METHOD AND APPARATUS FOR PRODUCING A PLASMA DISPLAY

(75) Inventors: Yuichiro Iguchi, Shiga (JP); Masahiro Matsumoto, Shiga (JP); Yuko Mikami, Shiga (JP); Takaki Masaki, Shiga (JP); Takao Sano, Shiga (JP); Yoshiyuki Kitamura, Shiga (JP); Yoshinori Tani, Shiga (JP); Hideki Ikeuchi, Kyoto (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 09/125,128

(22) PCT Filed: Dec. 16, 1997

(86) PCT No.: PCT/JP97/04643

§ 371 (c)(1),
(2), (4) Date: Aug. 25, 1998

(87) PCT Pub. No.: WO98/27570

PCT Pub. Date: Jun. 25, 1998

(65) Prior Publication Data

US 2002/0009536 A1 Jan. 24, 2002

(30) Foreign Application Priority Data

| | | |
|---|---|---|
| Dec. 17, 1996 | (JP) | 8/336713 |
| Mar. 31, 1997 | (JP) | 9/081555 |
| Jun. 27, 1997 | (JP) | 9/172339 |
| Jun. 27, 1997 | (JP) | 9/172354 |
| Jun. 27, 1997 | (JP) | 9/172364 |

(51) Int. Cl.
*B05D 5/06* (2006.01)
*B05C 5/00* (2006.01)

(52) U.S. Cl. ..... 427/68; 427/64; 427/256; 427/421.1; 118/315

(58) Field of Classification Search ..... 427/64, 427/68, 261, 385.5, 265, 266, 421.1–427.7, 427/256; 118/9, 10, 669, 677, 679, 680, 118/681, 713, 50, 58, 407, 412, 315
See application file for complete search history.

(56) References Cited

U.S. PATENT DOCUMENTS 4,680,231 A * 7/1987 Yamaura et al. ..... 428/407
4,775,080 A * 10/1988 Mettenbrink ..... 222/391

(Continued)

FOREIGN PATENT DOCUMENTS

| | | | |
|---|---|---|---|
| EP | 0 806 786 A1 | | 11/1997 |
| JP | 63-155527 | * | 6/1988 |
| JP | 63155527 | | 6/1988 |
| JP | 08-162019 | * | 6/1996 |
| WO | WO96/32281 | * | 10/1996 |

*Primary Examiner*—Timothy Meeks
*Assistant Examiner*—Jimmy Lin
(74) *Attorney, Agent, or Firm*—DLA Piper (US) LLP

(57) ABSTRACT

A method for producing a plasma display comprises the step of continuously applying a phosphor paste containing a phosphor powder and an organic compound onto a substrate with a plurality of barrier ribs, from a paste applicator with a plurality of outlet holes. A method for producing a plasma display comprises the steps of coating a substrate with a plurality of baffler ribs, with three phosphor pastes respectively containing a phosphor powder emitting light of red, green or blue, as stripes in the spaces between the respectively adjacent baffler ribs on the substrate, from a paste applicator with outlet holes, and heating to form a phosphor layer. An apparatus for producing a plasma display comprises a table for fixing a substrate with a plurality of baffler ribs, a paste applicator with a plurality of outlet holes to face the baffler ribs of the substrate, a supply means for supplying a phosphor paste to the paste applicator, and a moving means for three-dimensionally moving the table and the paste applicator relatively each other.

4 Claims, 7 Drawing Sheets

U.S. PATENT DOCUMENTS 4,792,723 A * 12/1988 Igarashi et al. ..... 313/503
5,136,207 A * 8/1992 Miyake et al. ..... 313/582
5,277,840 A * 1/1994 Osaka et al. ..... 252/301.36
5,466,325 A * 11/1995 Mizuno et al. ..... 156/344
5,556,665 A * 9/1996 Norris et al. ..... 427/64
5,656,574 A * 8/1997 Ravi-Chandar ..... 505/121
5,674,553 A * 10/1997 Shinoda et al. ..... 505/121
5,723,945 A * 3/1998 Schermerhorn ..... 313/581
5,741,746 A * 4/1998 Kohli et al. ..... 501/70
5,767,876 A * 6/1998 Koike et al. ..... 347/43
5,776,545 A * 7/1998 Yoshiba et al. ..... 427/64
5,846,110 A * 12/1998 Kanagu et al. ..... 445/25
5,850,241 A * 12/1998 Silverbrook ..... 347/54
5,921,836 A * 7/1999 Nanto et al. ..... 445/24
5,951,350 A * 9/1999 Aoki et al. ..... 445/24

* cited by examiner (A)

(B)

METHOD AND APPARATUS FOR PRODUCING A PLASMA DISPLAY

TECHNICAL FIELD

This disclosure relates to a method and apparatus for producing a new plasma display suitably used for wall mounted television sets, information displays, etc.

In recent years, with the progress of multimedia, displays for displaying diverse kinds of information play more important roles. In this connection, the displays are required to be larger and thinner, and liquid crystal displays are being used in many fields including notebook type personal computers. However, it is difficult to use liquid crystal displays for large television sets in view of price and response speed. So, as the most promising type of large displays, plasma displays attract attention.

The disclosure also relates to a means for providing a plasma display capable of forming a phosphor layer usable as a highly precise plasma display in this field.

BACKGROUND

A plasma display has electric discharge caused in discharge spaces formed between a front glass substrate and a rear glass substrate. The discharge yield ultraviolet rays with 147 nm as the central wavelength to be generated from xenon gas, and the ultraviolet rays excite phosphor to allow display. If discharge cells respectively selectively coated with any of phosphor emitting light of red, green and blue are caused to emit light by a drive circuit, they can display in full color.

A recently actively developed AC type plasma display has a structure in which a front glass substrate with display electrodes, dielectric layer and protective layer and a rear glass substrate with address electrodes, dielectric layer, barrier ribs and phosphor layer are bonded together, and in which the discharge spaces partitioned by striped barrier ribs are filled with He—Xe or Ne—Xe mixed gas.

A conventional method mainly used for forming a phosphor layer of red, green and blue necessary for a plasma display is a screen printing method in which phosphor pastes are respectively consisting of a phosphor powder and a binder resin. In this method, a screen mesh provided with openings corresponding to the spaces between respectively adjacent barrier ribs and shielded by an emulsion on the other portions is coated with phosphor pastes, so that the phosphor pastes may be transferred through the screen mesh at the portions requiring the phosphor pastes, i.e., the spaces between the respectively adjacent barrier ribs.

Japanese Patent Laid-Open (Kokai) No. 6-5205 proposes a method of using sandblast after screen printing, and Japanese Patent Laid-Open (Kokai) No. 5-144375 proposes a method of screen printing after coating with a crosslinking agent.

However, the methods using screen printing have a disadvantage since the screen is changed in form by repeated printing, the accuracy is low, making it difficult to form a phosphor layer capable of providing a highly precise plasma display, and also have a problem that the cost is high since the expensive screen must be frequently exchanged.

One known method for forming a phosphor layer suitable for a highly precise plasma display is to use photosensitive phosphor pastes respectively consisting of a phosphor powder and a photosensitive binder resin. In this method, a substrate with barrier ribs is fully coated with the photosensitive pastes, consequently the coated film is partially exposed with UV light using a photo mask, to form portions soluble in a developer and portions insoluble in the developer, and are developed, to leave necessary portions. However, in this method, since layers of the respective phosphors of red (R), green (G) and blue (B) are formed, the complicated process of coating, exposure, development, drying, etc. must be repeated three times for R, G and B. The method also has a disadvantage that phosphor pastes are greatly lost, to raise the cost.

It is also proposed to eject a phosphor paste from the tip of an ink jet nozzle, for forming a phosphor layer. However, this method must keep the paste viscosity at 0.2 poise or less since the paste must be ejected from the tip of an ink jet nozzle with a small diameter. So, since the amount of the phosphor powder in the paste cannot be increased, the thickness of the phosphor layer cannot be controlled advantageously. Furthermore, this method also has such a problem that the ink jet nozzle is clogged by the phosphor powder and cannot be practically used.

It could therefore be helpful to provide a method for producing a plasma display capable of highly accurately and simply forming a phosphor layer in the spaces between highly precise barrier ribs and An apparatus for producing the above high quality plasma display continuously at a high productivity level.

SUMMARY

The method for producing a plasma display comprises the step of continuously applying a phosphor paste containing a phosphor powder and an organic compound onto a substrate with a plurality of barrier ribs from a paste applicator with a plurality of outlet holes, to form a phosphor layer. The method for producing a plasma display also comprises the steps of coating a substrate with a plurality of barrier ribs, with three phosphor pastes respectively containing a phosphor powder emitting light of red, green or blue, as stripes in the spaces between the barrier ribs on the substrate, from a paste applicator with outlet holes, and heating to form a phosphor layer.

The method for producing a plasma display includes the following preferable embodiments.

(1) The space (S) between the respectively adjacent barrier ribs and the average diameter (D) of the outlet holes satisfy the following formula:

$$10\ \mu m \leqq D \leqq S \leqq 500\ \mu m$$

(2) The outlet holes are formed in a flat plate or as nozzles or needles.

(3) The paste applicator used has 20 to 2000 outlet holes, more preferably 150 to 2000 outlet holes.

(4) The paste applicator used has 16n±5 (n is a natural number) outlet holes.

(5) The paste applicator used has the outlet holes at a pitch of 0.12 to 3 mm.

(6) The paste applicator used has the outlet holes at a pitch corresponding to 3m times (m is an integer of 1 to 10) the pitch of the barrier ribs.

(7) The paste applicator used satisfies the following formula:

$$L/D = 0.1 \sim 600$$

where L is the length of the outlet holes, and D is the average diameter of the outlet holes.

(8) The paste applicator used for coating is 60 to 400 μm in the average diameter (D) of the outlet holes.

(9) The phosphor pastes are applied while the distance between the top ends of the barrier ribs formed on a glass substrate and the tips of the outlet holes of the paste applicator is kept at 0.01 to 2 mm.

(10) Pastes respectively containing a phosphor different in the color are applied from one paste applicator, and the shortest distance between the outlet holes applying phosphor pastes mutually different in color is 600 μm or more.

(11) Two or more independent paste applicators are simultaneously used for coating, and the two or more paste applicators are driven to travel at the same speed.

(12) Coating is effected one color by one color, and the coating of each color is followed by drying.

(13) The paste applicator and the glass substrate are moved relatively each other in parallel to the barrier ribs on the glass substrate.

(14) To stop the application of the phosphor pastes, the paste applicator is kept at a negative pressure internally.

(15) After the paste applicator and the substrate have started to move relative to each other in parallel to the barrier ribs on the substrate, the application of phosphor pastes is started, and before the relative movement is stopped, the application is stopped.

(16) Each of the phosphor powders used is 0.5 to 10 μm in grain size, of 50 wt % of the powder, and 0.1 to 2 $m^2/g$ in specific surface area.

(17) Each of the phosphor pastes used consists of 30 to 60 wt % of a phosphor powder, 5 to 20 wt % of a binder resin and a solvent, wherein the ratio by weight of the phosphor powder to the binder resin is 6:1~3:1.

(18) The binder resin is a cellulose compound.

(19) The solvent contains terpineol.

(20) A method for producing a plasma display in which three phosphor pastes respectively containing a phosphor powder emitting light of red, green or blue are applied to the spaces between respectively adjacent barrier ribs on a glass substrate, to form a phosphor plane, comprising the step of removing the phosphor existing in the portions other than the predetermined coating positions by letting them adhere to an adhesive material.

(21) The phosphor deposited at the top ends of the barrier ribs are removed by adhesion to an adhesive material.

(22) Each of the phosphor pastes used satisfies the following relation:

$$(2H+P-W)\times 5 \leqq H\times(P-W)\times a/100 \leqq (2H+P-W)\times 30$$

where H is the height of each barrier rib (μm); P is the pitch of the barrier ribs (μm); W is the width of each barrier ribs (μm); and a is the phosphor powder content of the phosphor paste (vol %).

(23) The phosphor pastes used have a viscosity of 2 to 50 Pa·s.

(24) The phosphor pastes are photosensitive phosphor pastes.

(25) Each of the photosensitive phosphor pastes used has the following composition:

| | |
|---|---|
| Organic component | 15 ~ 60 parts by weight |
| Phosphor powder | 40 ~ 85 parts by weight |
| Solvent | 10 ~ 50 parts by weight |

(26) The barrier ribs are provided as stripes with the following dimensions:

| | |
|---|---|
| Pitch | 100 ~ 250 μm |
| Stripe width | 15 ~ 40 μm |
| Height | 60 ~ 170 μm |

(27) The barrier ribs are black on the top surfaces.

(28) The lateral side wall thickness (T1) of the phosphor layer at the position corresponding to a half of the height of each barrier rib and the bottom wall thickness (T2) of the phosphor layer satisfy the following relation:

$$10 \leqq T1 \leqq 50\ \mu m$$

$$10 \leqq T2 \leqq 50\ \mu m$$

$$0.2 \leqq T1/T2 \leqq 5$$

The apparatus for producing a plasma display comprises a table for fixing a substrate with a plurality of barrier ribs, a paste applicator with a plurality of outlet holes to face the barrier ribs of the substrate, a supply means for supplying a phosphor paste to the paste applicator, and a moving means for three-dimensionally moving the table and the paste applicator relatively each other.

The apparatus for producing a plasma display includes the following preferable embodiments.

(29) The relation between the average diameter (D) of the outlet holes of the paste applicator and the space (S) between the respectively adjacent barrier ribs satisfies the following formula:

$$10\ \mu m \leqq D < S \leqq 500\ \mu m$$

(30) The outlet holes of the paste applicator are not circularly formed, and the length (B) of each of the holes almost perpendicular to the partitions and the space (S) between the respectively adjacent barrier ribs satisfy the following relation:

$$10\ \mu m \leqq B \leqq S \leqq 500\ \mu m$$

(31) The pitch of the outlet holes of the paste applicator is 3m times (m is an integer of 1 to 10) the pitch of the barrier ribs.

(32) The outlet holes of the paste applicator are on the same plane.

(33) The outlet holes of the paste applicator are formed by pipes with the same form.

(34) The number of outlet holes of the paste applicator is 20 to 2000.

(35) The number of outlet holes of the paste applicator is 16n ±5 (n is a natural number).

(36) The pitch of the outlet holes of the paste applicator is 0.12 to 3 mm.

(37) The average diameter (D) of the outlet holes of the paste applicator and the length (L) of each of the outlet holes satisfy the following relation:

$$L/D = 0.1 \sim 600$$

(38) The average diameter of the outlet holes of the paste applicator is 60 to 400 μm.

(39) The centers of the outlet holes of the paste applicator are located above the spaces between the respective adjacent barrier ribs.

(40) The faces and/or inner walls of the outlet holes of the paste applicator are coated with a fluorine based resin film.

(41) The faces and/or inner walls of the outlet holes of the paste applicator are coated with an amorphous carbon film.

(42) The paste applicator has a plurality of phosphor paste storage sections, phosphor paste supply ports for supplying phosphor pastes to the storage sections, and passages for fluid communication between the storage sections and the outlet holes; the number of outlet holes is larger than the number of storage sections; and the outlet holes corresponding to the respective storage sections are arranged cyclically according to a predetermined order almost on a straight line.

(43) Two or more paste applicators are arranged.

(44) A plurality of paste applicators are provided for respectively different phosphor pastes, and a plurality of phosphor paste supply devices are provided to supply the phosphor pastes for the respective paste applicators, so that the spaces between the barrier ribs of the substrate may be simultaneously coated with the plurality of phosphor pastes.

(45) A pressure adjusting means capable of setting the pressure in the paste applicator as desired in a range from atmospheric pressure to a negative pressure, and a control means to control the timing of the pressure adjustment are provided.

(46) A detecting means for detecting the positions of the outlet holes of the paste applicator, a detecting means for detecting the positions of the barrier ribs or the spaces between the barrier ribs of the substrate, a detecting means for detecting the position of the top ends of the barrier ribs on the substrate, a detecting means for detecting the position of the tips of the outlet holes of the paste applicator and a control means for controlling the start and end of application of the phosphor paste in response to the relative position between the outlet holes of the paste applicator and the substrate are provided.

(47) An adjusting means for adjusting the inclination degree of the paste applicator to the top ends of the barrier ribs of the substrate, and a control means for keeping the tips of the outlet holes of the paste applicator at a predetermined distance from and in almost parallel to the top ends of the barrier ribs of the substrate are provided.

(48) A detecting means for detecting the position in the substrate, of the phosphor pastes applied from the paste applicator onto the substrate is provided.

(49) A detecting means for detecting the number of the barrier ribs or the spaces between the barrier ribs on the substrate, and a recognizing means for recognizing the spaces between the barrier ribs to be coated, from the detected number of the barrier ribs or the spaces between the barrier ribs are provided.

(50) A reference mark detecting means for detecting a reference mark on the substrate, and a moving means and control means for relatively moving the paste applicator and the barrier ribs so that the outlet holes of the paste applicator may be located above the spaces between the barrier ribs to be coated with the phosphor paste are provided.

(51) A means for cleaning the outlet hole faces of the paste applicator is provided.

(52) A means for removing the phosphor paste existing in other portions than the predetermined coating positions of the substrate is provided.

(53) Three coating devices are provided in series to respond to three phosphor pastes, which are respectively equipped with a table for fixing a substrate with barrier ribs formed on the surface, a paste applicator with a plurality of outlet holes to face the barrier ribs of the substrate, a supply means for supplying phosphor pastes to the paste applicator, and a moving means for three-dimensionally moving the table and the paste applicator relatively each other.

Figure 1:
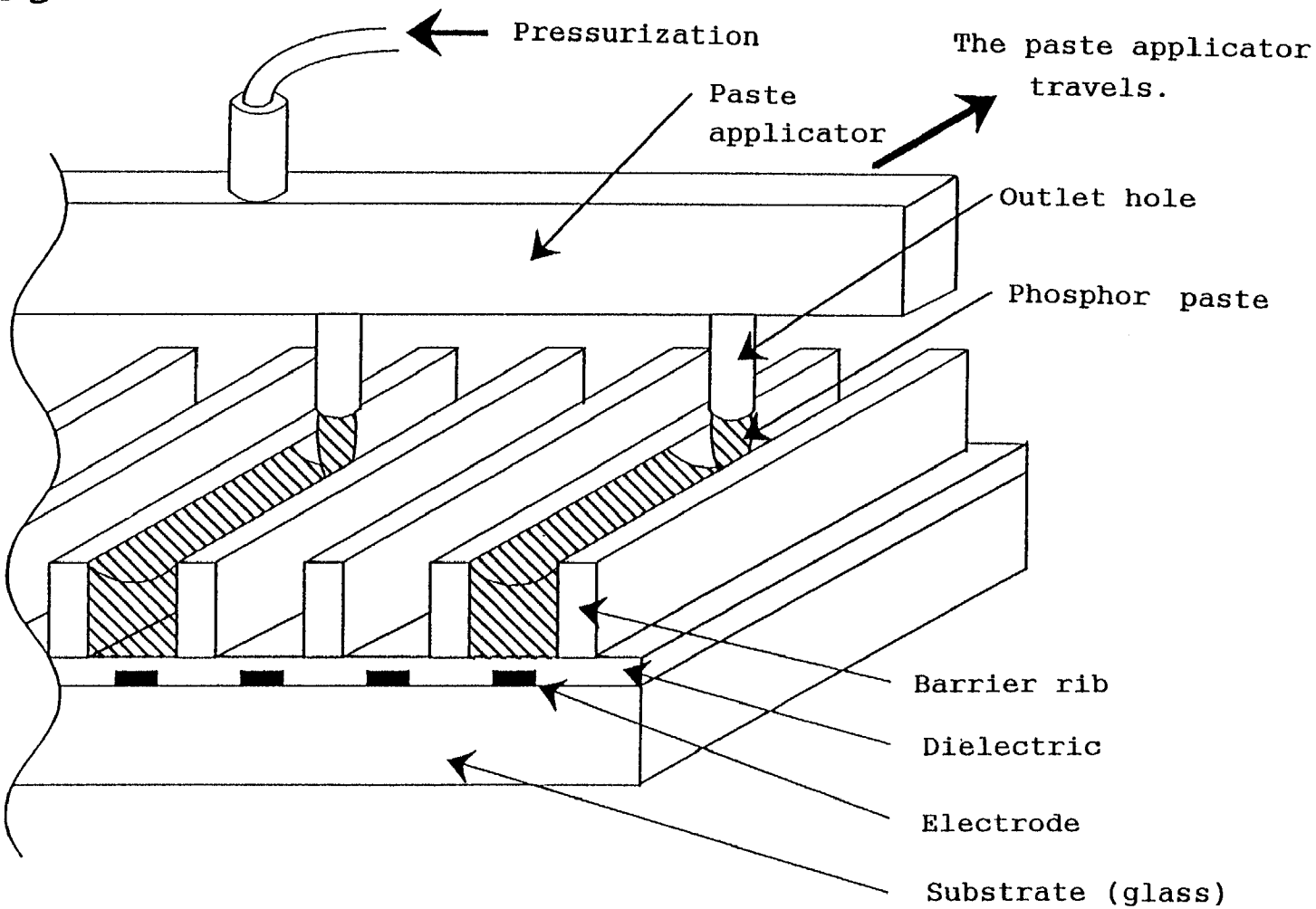
FIG.1. is a schematic drawing of a coating device for illustrating an example of the photosensitive paste coating process.

In the above drawings, the respective symbols denote the following:

2 base
4 substrate
6 table
7 suction hole
8 grooved guide rail
9 slide stand
10 feed screw
11 connector
12 bearing
16 AC servo motor
20 paste applicator
22 holder
24 horizontal bar
26 linear actuator
28 lift bracket
29 expansion rod
30 lift mechanism
32 Y-axis moving bracket
34 pillar
36 transverse moving mechanism
38 sensor support
40 height sensor
41 manifold
42 phosphor paste
44 outlet hole
46 supply hose
48 electromagnetic change-over valve for discharge
50 supply unit
52 suction hose
54 electromagnetic change-over valve for suction
56 phosphor paste tank
58 supply device controller
60 general controller
62 motor controller
64 sensor bracket
66 position sensor
68 position sensor
70 camera support
72 camera
74 image processor
76 actuator for lift mechanism
78 actuator for transverse moving mechanism
501 outlet hole
601 pipe
701 phosphor paste supply port
702 phosphor paste storage section
703 passage
704 outlet hole
801 paste applicator

802 paste applicator
901 cleaning device
902 outlet hole face
903 wiping member
904 bracket
905 tray
906 drain port
907 tube
908 lift section
909 guide
910 moving unit
911 mount
912 ball screw

DETAILED DESCRIPTION

A plasma display mainly consists of a front glass substrate and a rear glass substrate, and has a rare gas contained between the substrate sealed.

The rear substrate must have a phosphor layer formed on a substrate on which electrodes for applying a drive voltage and barrier ribs for partitioning electric discharge cells are formed. Furthermore, on the substrate, a dielectric layer may be formed for stabilization of electric discharge. The substrate can be a soda glass substrate or a glass substrate of PD200 (produced by Asahi Glass), etc. marketed for the plasma display, or a ceramic substrate. As the substrate, it is preferable to use a 1 to 3 mm thick glass substrate, and more preferable is a 2 to 3 mm thick glass substrate.

On the substrate, electrodes made of a conductive metal are formed. A preferably used electrode material is a metallic material containing at least one metal selected from gold, silver, copper, chromium, palladium, aluminum and nickel. Any of these metallic materials is used to form electrodes in a necessary pattern preferably with a thickness of 0.1 to 10 μm, more preferably with a thickness of 1 to 5 μm.

The electrode pattern can be formed, for example, by printing a pattern using a metallic paste obtained by kneading a metallic powder and an organic binder containing a cellulose compound such as ethyl acetate, onto a glass substrate through a screen, or forming a metallic film on a glass substrate by vacuum evaporation or sputtering, and etching using a resist. As a further other preferable method, electrodes can be formed by coating a glass substrate with a photosensitive paste obtained by kneading a metallic powder and an organic binder containing a photosensitive organic component, exposing it to a pattern using a photo mask, developing to remove the portions soluble in the developer, and burning at 500 to 600° C. This method allows highly precise electrodes to be formed highly accurately.

If a dielectric layer is formed on the electrodes, light emission can be stabilized. The dielectric can be formed by coating with a glass paste consisting of a glass powder and an organic binder containing a cellulose compound such as ethyl cellulose, and burning at 450 to 600° C.

The barrier ribs can be formed by various methods. They can be formed, for example, by printing a pattern using a glass paste consisting of a glass powder and an organic binder containing a cellulose compound such as ethyl cellulose through a screen in a multi-layer, and burning at 450 to 600° C.

The barrier ribs can also be formed by coating the substrate fully with a glass paste, laminating a dry film resist, and grinding by sand blasting, using a pattern formed by photolithography as a mask, and burning. It is preferable that the barrier ribs are formed by fully coating the substrate with a photosensitive glass paste obtained by kneading a glass powder and a photosensitive organic component, forming a pattern by photolithography using a photo mask, and burning. The barrier ribs can be formed as stripes or lattice for partitioning the electric discharges of the respective electric discharge cells. Barrier ribs formed as stripes are preferable since they can be formed simply at a low cost.

A phosphor layer can be formed on a glass substrate with highly precise barrier ribs, though it is difficult to do so by conventional screen printing. For example, when the barrier ribs are in stripes with the following preferable dimensions, a phosphor layer with few defects compared to that obtained by screen printing can be formed.

| | |
|---|---|
| Pitch | 100 ~ 250 μm |
| Width | 15 ~ 40 μm |
| Height | 60 ~ 170 μm |

When the outlet holes are located between respectively adjacent barrier ribs, the image can be more easily recognized if the top ends of the barrier ribs on the substrate are black.

Onto the glass substrate with the barrier ribs as described above, pastes respectively containing a phosphor powder are applied from a paste applicator with a plurality of outlet holes, for forming the phosphor layer.

The phosphor powders used emit light of red, green and blue. As the phosphor powders used, those emitting light of red include $Y_2O_3$:Eu, $YVO_4$:Eu, (Y, Gd)$BO_3$:Eu, $Y_2O_3S$:Eu, γ-$Zn_3(PO_4)_2$: Mn, (ZnCd)S: Ag+$In_2O_3$, etc. Those emitting light of green include $Zn_2GeO_2$:Mn, $BaAl_{12}O_{19}$:Mn, $Zn_2SiO_4$:Mn, $LaPO_4$:Tb, ZnS:Cu,Al, ZnS:Au,Cu,Al, (ZnCd)S:Cu,Al, $Zn_2SiO_4$:Mn,As, $Y_3Al_5O_{12}$:Ce, $CeMgAl_{11}O_{19}$:Tb, $Gd_2O_2S$:Tb, $Y_3Al_5O_{12}$:Tb, ZnO:Zn, etc. Those emitting light of blue include $Sr_5(PO_4)_3Cl$:Eu, $BaMgAl_{14}O_{23}$:Eu, $BaMgAl_{16}O_{27}$:Eu, $BaMg_2Al_{14}O_{24}$:Eu, ZnS:Ag+red pigment, $Y_2SiO_3$:Ce, etc.

Rare earth element tantalate phosphor in which at least one matrix forming rare earth element selected from yttrium (Y), gadolinium (Gd) and lutetium (Lu) is substituted by at least one element selected from a group consisting of thulium (Tm), terbium (Tb) and europium (Eu). A preferable rare earth element tantalate phosphor is europium activated yttrium tantalate represented by composition formula $Y_{1-x}Eu_xTaO_4$(where x is approximately 0.005 to 0.1). A preferable red phosphor is europium activated yttrium tantalate, and a preferable green phosphor is terbium activated yttrium tantalate represented by composition formula $Y_{1-x}Eu_xTaO_4$ (where x is approximately 0.001 to 0.2). A preferable blue phosphor is terbium activated yttrium tantalate represented by $Y_{1-x}Eu_xTaO_4$(where x is approximately 0.001 to 0.2). Further preferable green phosphor include a manganese activated zinc phosphor ($Zn_2SiO_4$:Mn) with an average grain size of 2.0 μm to 8.0 μm activated by 0.2 wt % to less than 0.1 wt % of manganese based on the weight of zinc silicate ($Zn_2SiO_4$) matrix, and a manganese activated zinc silicate phosphor represented by general formula $(Zn_{1-x}n_x)O\cdot\alpha SiO_2$ (where $0.01\leqq x\leqq 0.2$ and $0.5<\alpha\leqq 1.5$).

The grain size of the above phosphor powders used can be selected, considering the line width, inter-line space and thickness of the phosphor layer pattern to be prepared. However, it is preferable that the grain size of 50 wt % of the grains is 0.5 to 10 μm, and that the specific surface is 0.1 to 2 $m^2/g$. It is more preferable that the grain size of 50 wt % of the grains is 0.5 to 5 μm, and that the specific surface area is 0.2 to 1.0 $m^2/g$. It is preferable that the grain size and the specific surface area are in these ranges, since the paste kneadability can be enhanced to allow a dense phosphor layer to be formed, for improving the light emission efficiency and elongating the life. If the grain size of the powder is less than 0.5 μm or the specific surface area is 2 $m^2/g$ or more, then the powder is so fine that the life till the light emission luminance declines is shortened.

It is preferable that the phosphor powder is polyhedral grains and is not cohesive. It is especially preferable that the powder is spherical grains since a dense phosphor layer can be formed, to improve the light emission efficiency advantageously. It is preferable that spherical grains account for 80% or more in the fluorescent powder as the number of grains. It is more preferable that spherical grains account for 90% or more. To measure the spherical grain percentage, the fluorescent powder is photographed at 300 times by an optical microscope, and the number of countable grains is counted, to calculate the rate of spherical grains as the spherical grain percentage.

The organic component contains a binder resin, solvent and, as required, such additives as a plasticizer, dispersing agent and leveling agent.

The binder resins which can be used here include, for example, polyvinyl butyral, polyvinyl acetate, polyvinyl alcohol, polyethylene, silicone polymers (e.g., polymethylsiloxane and polymethylphenylsiloxane), polystyrene, butadiene/styrene copolymer, polyvinyl pyrrolidone, polyamides, high molecular polyethers, ethylnene oxide/propylene oxide copolymer, polyacrylamide and various acrylic polymers (e.g., sodium polyacrylate, poly-lower-alkyl acrylates, poly-lower-alkyl methacrylates, and various copolymers and multipolymers of lower alkyl acrylates and methacrylates. Furthermore, if a cellulose compound (e.g., methyl cellulose, ethyl cellulose, hydroxyethyl cellulose or methylhydroxyethyl cellulose), etc., is used as a preferable binder resin, the phosphor layer formed is small in the binder residue after burning.

The plasticizers which can be used here include, for example, dibutyl phthalate, dioctyl phthalate, polyethylene glycol, glycerol, etc.

The solvents which can be used here include, for example, alcohol based solvents such as terpineol, isobutyl alcohol, isopropyl alcohol, benzyl alcohol, 2-phenoxyethanol, γ-phenylallyl alcohol, dimethylbenzyl carbinol, β-phenylethyl alcohol, methyl cellosolve, ethyl cellosolve and butyl cellosolve, methyl ethyl ketone, dioxane, acetone, cyclohexanone, cyclopentanone, tetrahydrofuran, butylcarbitol acetate, dimethyl sulf oxide, γ-butyrolactone, bromobenzene, chlorobenzene, dibromobenzene, dichlorobenzene, bromobenzoic acid, chlorobenzoic acid and organic solvent mixtures containing at least one or more of the foregoing. Especially alcohol based solvents are advantageous for dispersing the powder. Among them, terpineol is especially preferable. Furthermore, if terpineol and another alcohol based solvent such as benzyl alcohol are used as a mixture, the viscosity of the paste can be easily adjusted.

The fluorescent powder, binder and solvent are mixed and kneaded at a desired ratio, to prepare a phosphor paste. It is preferable to use a paste with a viscosity of 2 to 50 Pa·s, since the thickness of the lateral side wall along each barrier rib can be easily controlled when the paste is applied for coating, and this is effective for achieving higher uniformity in luminance and display.

If a phosphor paste with a ratio by weight of a fluorescent powder : a binder of 6:1~3:1 is used, the uniformity in thickness can be further improved to allow a highly precise plasma display to be prepared. A preferable paste composition consists of 30 to 60 wt % of a phosphor powder emitting light of any one color of red, green and blue, 5 to 20 wt % of a binder resin and 20 to 65 wt % of a solvent. If such a composition is used, a uniformly thick phosphor layer can be formed as the lateral side wall along each barrier rib and as the bottom wall of each electric discharge space.

Moreover, if a paste composition satisfying the following relation is used, a uniformly thick phosphor layer can be formed as the lateral side wall along each partition and as the bottom wall of each electric discharge space:

$$(2H+P-W)\times 5 \leqq H\times(P-W)\times a \leqq (2H+P-W)\times 30$$

where H is the height of each barrier rib of the plasma display to be prepared (μm); P is the pitch of the barrier ribs (μm); W is the width of each barrier rib (μm); and a is the amount of the phosphor powder contained in the phosphor paste (vol %).

The phosphor paste can contain an organic dye, to allow coated portions to be more easily distinguished from non-coated portions. In this case, if the layer of the phosphor of red, green and blue contains organic dyes capable of developing respectively different colors, the defect inspection after coating can be effected more easily. The organic dyes which can be used here include leuco dyes, azo dyes, aminoketone dyes, xanthene dyes, quinoline dyes, aminoketone dyes, anthraquinone dyes, benzophenone dyes, diphenyl cyanoacrylate dyes, triazine dyes, p-aminobenzoic acid dyes, etc., concretely, Sudan Blue, Sudan 4, Victoria Pure Blue, Nile Blue, Brilliant Green, Neutral Red, Methyl Violet, etc.

A photosensitive phosphor paste containing a photosensitive compound as a binder resin can also be used. If a photosensitive phosphor paste is used, the phosphor paste deposited in unnecessary portions can be removed by exposure and development using a photo mask. Especially when the phosphor paste is deposited on the top surfaces of discharge failure can be prevented by exposing only the portions to be coated, to light, and removing the portions not exposed with the light, by development.

The organic component containing a photosensitive compound used in the photosensitive phosphor paste contains at least one photosensitive component selected from photosensitive polymers, photosensitive monomers and photosensitive oligomers, and further contains, as required, such additives as a photo polymerization initiator, sensitizer and ultraviolet light absorber.

A photosensitive phosphor paste consisting of 15 to 60 parts by weight of an organic component, 40 to 85 parts by weight of a phosphor powder and 10 to 50 parts by weight of a solvent is effective for improving thickness uniformity and pattern formability.

It is preferable that the amount of the organic component containing a photosensitive compound is 15 to 60 wt %. If the amount is less than 15 wt %, the pattern formability declines due to insufficient photosensitivity. If larger than 60 wt %, the capability to remove the binder at the time of burning is poor, and burning tends to be insufficient.

The photosensitive component can be either a light insolubilizable photosensitive component or a light solubilizable photosensitive component. The light insolubilizable photosensitive components which can be used here include the following:

(A) A component which contains one or more functional monomers, oligomers and polymers with one or more unsaturated groups in the molecule (B) A component which contains a photosensitive compound such as an aromatic diazo compound, aromatic diazide component or organic halogen compound (C) A so-called diazo resin such as a condensation product of a diazo based amine and formaldehyde The light solubilizable photosensitive components which can be used here include the following:

(D) A component which contains a complex of a diazo compound with an inorganic salt or organic acid, or quinonediazo (E) Naphthoquinone 1,2-diazido-5-sulfonate of phenol or novolak resin, etc. obtained by combining a quinonediazo with a proper polymer binder All of the above photosensitive components can be used, but a photosensitive component of (A) is especially preferable. A photosensitive paste with inorganic fine grains mixed can also be simply used.

A photosensitive monomer refers to a compound with a carbon-carbon unsaturated bond. The photosensitive monomers which can be used here include, for example, methyl acrylate, ethyl acrylate, n-propyl acrylate, isopropyl acrylate, n-butyl acrylate, sec-butyl acrylate, iso-butyl acrylate, tert-butyl acrylate, n-pentyl acrylate, allyl acrylate, benzyl acrylate, butoxyethyl acrylate, butoxy triethylene glycol acrylate, cyclohexyl acrylate, dicyclopentanyl acrylate, dicyclopentenyl acrylate, 2-ethylhexyl acrylate, glycerol acrylate, glycidyl acrylate, heptadecafluorodecyl acrylate, 2-hydroxyethyl acrylate, isobornyl acrylate, 2-hydroxypropyl acrylate, isodecyl acrylate, isooctyl acrylate, lauryl acrylate, 2-methoxyethyl acrylate, methoxy ethylene glycol acrylate, methoxy diethylene glycol acrylate, octafluoropentyl acrylate, phenoxyethyl acrylate, stearyl acrylate, trifluoroethyl acrylate, allylated cyclohexyl diacrylate, 1,4-butanediol diacrylate, 1,3-butylene glycol diacrylate, ethylene glycol diacrylate, diethylene glycol diacrylate, triethylene glycol diacrylate, polyethylene glycol diacrylate, dipentaerythritol hexaacrylate, dipentaerythritol monohydroxypentaacrylate, ditrimethylolpropane tetraacrylate, glycerol diacrylate, methoxylated cyclohexyl diacrylate, neopentyl glycol diacrylate, propylene glycol diacrylate, polypropylene glycol diacrylate, triglycerol diacrylate, trimethylolpropane triacrylate, acrylamide, aminoethyl acrylate, phenyl acrylate, phenoxyethyl acrylate, benzyl acrylate, 1-naphthyl acrylate, 2-naphthyl acrylate, bisphenol A diacrylate, diacrylate of bisphenol A—ethylene oxide addition product, diacrylate of bisphenol A—propylene oxide addition product, thiophenol acrylate, benzylmercaptane acrylate, monomers obtained by substituting the hydrogen atoms of these aromatic rings by 1 to 5 chlorine or bromine atoms, styrene, p-methylstyrene, o-methylstyrene, m-methylstyrene, chlorinated styrene, brominated styrene, α-methyl styrene, chlorinated α-methylstyrene, brominated α-methylstyrene, chloromethylstyrene, hydroxymethylstyrene, carboxymethylstyrene, vinylnaphthalene, vinylanthracene, vinylcarbazole, compounds obtained by substituting the acrylate in the molecule of each of the above compounds partially or wholly by methacrylate, γ-methacryloxypropyltrimethoxysilane, 1-vinyl-2-pyrrolidone, etc. One or more of these compounds can be used.

If an unsaturated acid such as an unsaturated carboxylic acid is added to the photosensitive paste, in addition to the above, the developability after sensitizing can be further improved. The unsaturated carboxylic acids which can be used here include acrylic acid, methacrylic acid, itaconic acid, crotonic acid, maleic acid, fumaric acid, vinylacetic acid and anhydrides of these acids, etc.

The binders which can be used here include polyvinyl alcohol, polyvinyl butyral, methacrylate polymers, acrylate polymers, acrylate-methacrylate copolymers, α-methylstyrene polymer, butyl methacrylate resin, etc.

Furthermore, oligomers and polymers obtained by polymerizing at least one of the above mentioned compounds with a carbon-carbon double bond can also be used. For polymerization, 10 wt % or more, preferably 35 wt % or more of any of these monomers and another photosensitive monomer can be copolymerized.

As the monomer to be copolymerized, if an unsaturated acid such as an unsaturated carboxylic acid is copolymerized, the developability after sensitizing can be further improved. The unsaturated carboxylic acids which can be used here include, for example, acrylic acid, methacrylic acid, itaconic acid, crotonic acid, maleic acid, fumaric acid, vinylacetic acid, anhydrides of these acids, etc.

It is preferable that the acid value (AV) of the polymer or oligomer with acidic groups such as carboxyl groups in the side chains obtained like this is 50 to 180. A more preferable range is 70 to 140. If the acid value exceeds 180, the development allowable range becomes narrow. If the acid value is less than 50, the solubility of non-exposed portions to the developer declines, to raise the developer concentration, and also the exposed portions peel, making it hard to obtain a highly precise pattern.

If photo-reactive groups are added to the side chains or molecular ends of the above polymer or oligomer, it can be used as a photosensitive polymer or photosensitive oligomer. Preferable photo-reactive groups are ethylenic unsaturated groups which include vinyl groups, allyl groups, acryl groups, methacryl groups, etc.

Such side chains can be added to an oligomer or polymer, by letting an ethylenic unsaturated compound with a glycidyl group or isocyanato group or acrylic acid chloride, methacrylic acid chloride or allyl chloride addition-react with the mercapto groups, amino groups, hydroxyl groups or carboxyl groups in the polymer.

The ethylenic unsaturated compounds with a glycidyl group which can be used here include glycidyl acrylate, glycidyl methacrylate, allyl glycidyl ether, glycidyl ethylacrylate, crotonyl glycidyl ether, glycidyl crotonate ether, glycidyl isocrotonate ether, etc.

The ethylenic unsaturated compounds with an isocyanato group which can be used here include (meth)acryloyl isocyanate, (meth)acryloylethyl isocyanate, etc.

It is preferable to add an ethylenic unsaturated compound with a glycidyl group or isocyanate, acrylic acid chloride, methacrylic acid chloride or allyl chloride by 0.05 to 1 mole equivalent for each mole equivalent of the mercapto groups, amino groups, hydroxyl groups or carboxyl groups in the polymer.

The photo polymerization initiators which can be used here include, for example, benzophenone, methyl o-benzoylbenzoate, 4,4-bis(dimethylamine)benzophenone, 4,4-bis(diethylamino)benzophenone, 4,4-dichlorobenzophenone, 4-benzoyl-4-methyl diphenyl ketone, dibenzyl ketone, fluorenone, 2,2-diethoxyacetophenone, 2,2-dimethoxy-2-phenyl-2-phenylacetophenone, 2-hydroxy-2-methylpropiophenone, p-t-butyldichloroacetophenone, thioxanthone, 2-methylthioxanthone, 2-chlorothioxanthone, 2-isopropylthioxanthone, diethylthioxanthone, benzyl, benzyldimethyl ketanol, benzylmethoxyethyl acetal, benzoin, benzoin methyl ether, benzoin butyl ether, anthraquinone, 2-t-butylanthraquinone, 2 -amylanthraquinone, β-chloroanthraquinone, anthrone, benzanthrone, dibenzosuberone, methyleneanthrone, 4-azidobenzalacetophenone, 2,6-bis(p-azidobenzylidene)cyclohexanone, 2,6-bis(p-azidobenzylidene)-4-methylcyclohexanone, 2-phenyl-1,2-butadione-2-(o-methoxycarbonyl) oxime, 1-phenyl-propanedione-2-(o-ethoxycarbonyl)oxime, 1,3 -diphenyl-propanetrione-2-

(o-ethoxycarbonyl) oxime, 1-phenyl-3-ethoxy-propanetrione-2-(o-benzoyl)oxime, Michler's ketone, 2-methyl-[4-(methylthio)phenyl]-2-morphlino-1propanone, naphthalenesulfonyl chloride, quinolinesulfonyl chloride, N-henylthioacridone, 4,4azobisisobutyronitrile, diphenyl disulfide, benzthiazole disulfide, triphenylphosphine, camphorquinone, carbon tetrabromide, tribromophenylsulfone, benzoyl peroxide and combinations consisting of a photo-reducing dye such as Eosine or Ethylene Blue and a reducing agent such as ascorbic acid or triethanolamine. One or more of them can be used.

It is preferable that the amount of the photo polymerization initiator is 0.1 to 6 wt % based on the amount of the photosensitive component, and a more preferable range is 0.2 to 5 wt %. If the amount of the polymerization initiator is too small, the sensitivity to light becomes poor, and if too large, the exposed portion remaining rate may become too small.

It is also effective to add an ultraviolet light absorber to the photosensitive paste. If an absorber high in ultraviolet light absorbing effect is added, a high aspect ratio, high preciseness and high resolution can be obtained. As the ultraviolet light absorber, an organic dye can be used. Above all, it is preferable to use an organic dye with a high UV absorption coefficient in a wavelength range of 350 to 450 nm. The organic dyes which can be used here include azo dyes, aminoketone dyes, xanthene dyes, quinoline dyes, aminoketone dyes, anthraquinone dyes, benzophenone dyes, diphenylcyanoacrylate dyes, triazine dyes, p-aminobenzoic acid dyes, etc. An organic dye is preferable since it does not remain in the burned insulation film even if it is added as a light absorber and since the decline of the insulation film properties by the light absorber can be decreased. Among the organic dyes, especially azo dyes and benzophenone dyes are preferable. It is preferable that the amount of the organic dye is 0.05 to 5 wt %. If the amount of the organic dye is too small, the effect of adding an ultraviolet light absorber decreases, and if too large, the properties of the burned insulation film decline unpreferably. A more preferable range in the amount of the organic dye added is 0.15 to 1 wt %.

An organic pigment as an ultraviolet light absorber can be added, for example, by preparing a solution with an organic pigment dissolved in an organic solvent, mixing a glass powder into the organic solvent, and drying. According to this method, capsules with the surfaces of individual grains of the glass powder coated with an organic film can be produced.

A sensitizer is added to improve the sensitivity of the photosensitive paste. The sensitizers which can be used here include, for example, 2,4-diethylthioxanthone, isopropylthioxanthone, 2,3-bis(4-diethylaminobenzal)cyclopentanone, 2,6-bis (4 -dimethylaminobenzal)cyclohexanone, 2,6-bis(4-dimethylaminobenzal)-4-methylcyclohexanone, Michler's ketone, 4,4-bis(diethylamino)-benzophenone, 4,4-bis(dimethylamino)chalcone, 4,4 -bis(diethylamino)chalcone, p-dimethylaminocinnamylideneindanone, p-dimethylaminobenzylideneindanone, 2-(p-dimethylaminophenylvinylene)-isonaphthothiazole, 1,3-bis(4-dimethylaminobenzal)acetone,1,3-carbonyl-bis(4-diethylaminobenzal) acetone, 3, 3-carbonyl-bis(7-diethylaminocoumarin), N-phenyl-N-ethylethanolamine, N-phenylethanolamine, N-tolyldiethanolamine, N-phenylethanolamine, isoamyl dimethylaminobenzoate, isoamyl diethylaminobenzoate, 3-phenyl-5-benzoylthiotetrazole, 1-phenyl-5-ethoxycarbonylthiotetrazole, etc. One or more of them can be used. Among sensitizers, some can be used also as photo polymerization initiators. When a sensitizer is added to the photosensitive paste, the amount is usually 0.05 to 10 wt % based on the amount of the photosensitive component. A preferable range is 0.1 to 10 wt %. If the amount of the sensitizer is too small, the effect of improving the photosensitivity cannot be manifested, and if too large, the exposed portion remaining rate may become too small.

A photosensitive phosphor paste is usually produced by mixing a phosphor powder, ultraviolet light absorber, photosensitive polymer, photosensitive monomer, photo polymerization initiator and solvent at a predetermined ratio, and homogeneously mixing and dispersing the mixture by a three-roller mill or kneading machine.

The viscosity of the paste can be properly adjusted by adjusting the mixing ratio of the phosphor powder, organic solvent, plasticizer, precipitation preventive, etc. A preferable viscosity range is 2 to 50 Pa·s, and a more preferable range is 5 to 20 Pa·s.

Figure 2:
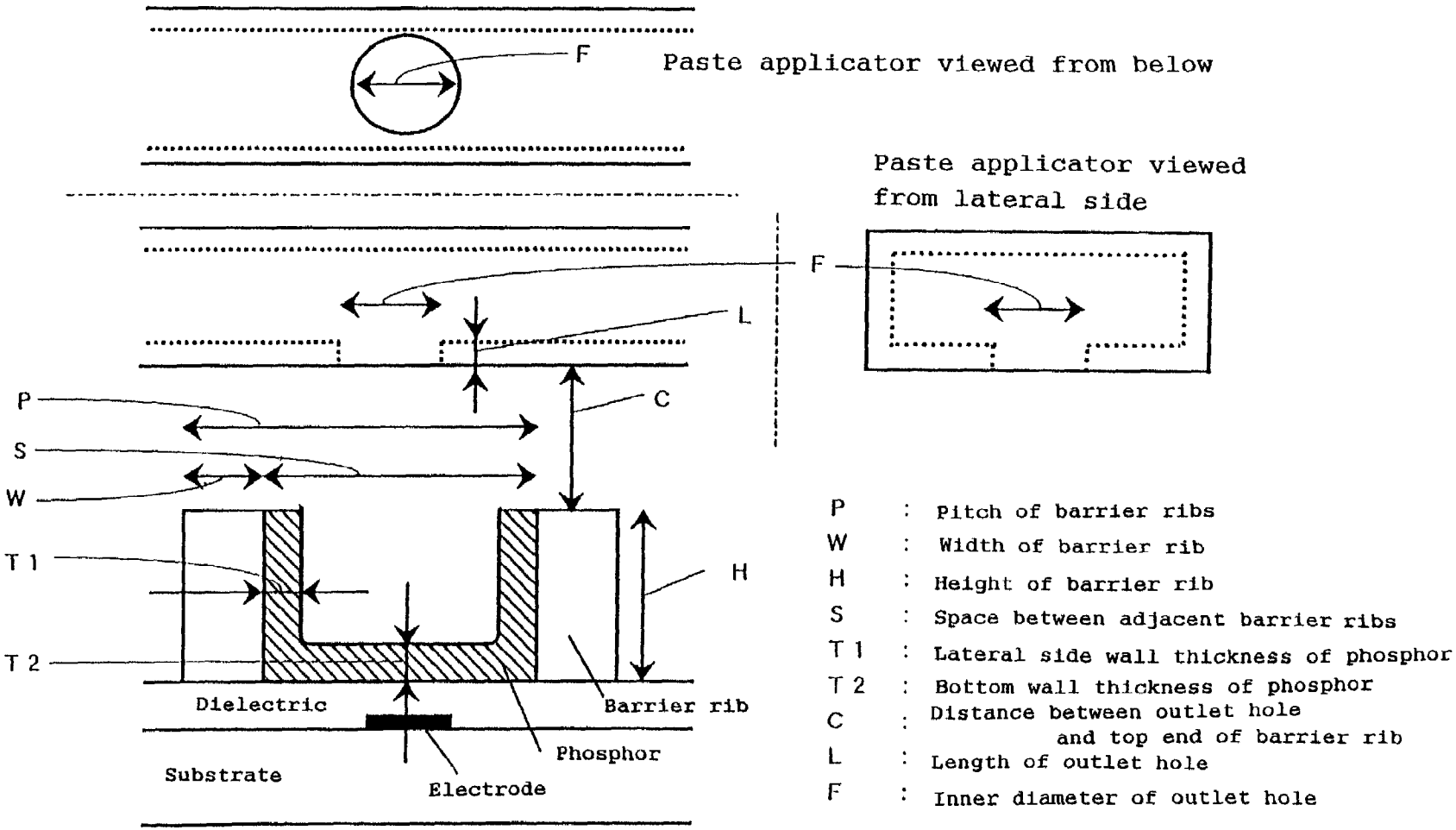
FIG. 2. is a sectional view for illustrating the relation between the substrate for the plasma display and the paste applicator for coating.

How to form the phosphor layer is described below. A phosphor paste prepared as described above is applied to the spaces between the respectively adjacent barrier ribs. of the substrate with a plurality of barrier ribs. FIG. 1 shows a state where the phosphor paste is applied from the outlet holes of a paste applicator to coat the spaces between the respectively adjacent phosphor of the substrate provided with electrodes, dielectric and barrier ribs. FIG. 2 is an illustration for explaining the positional relation between the substrate and the paste applicator, and will be very useful for understanding the structure described below.

As the outlet holes for applying the phosphor paste, a metallic, ceramic or plastic paste applicator with outlet holes, nozzles or needles at the tip can be used. The outlet holes can have an inner diameter of 10 to 500 μm, and a preferable diameter range is 50 to 500 μm. If the hole diameter is smaller than 10 μm, the phosphor powder is liable to clog the holes, and if the hole diameter is larger than 500 μm, there arises such a problem that the phosphor paste leaks onto adjacent cells in highly precise coating. If the spaces (S) between the respectively adjacent barrier ribs and the average diameter (D) of the outlet holes satisfy the following relation, the application of the phosphor paste onto the top surfaces of the barrier ribs can be further inhibited.

$$10\ \mu m \leqq D \leqq S \leqq 500\ \mu m$$

The number of outlet holes can be 1 to 6000, but a desirable range is 20 to 2000. If the number of outlet holes is too small, it takes too much time for coating. If the number is 150 or more desirably, a phosphor layer suitable for a highly precise plasma display can be formed in a short time. If the number of holes exceeds 2000, it is difficult to secure the accuracy of the outlet holes, and to provide a highly precise plasma display. If the number of outlet holes is kept in a range of 16n±5 (n is a natural number), a phosphor layer suitable for a plasma display capable of being driven on a general purpose circuit can be easily formed.

It is desirable that the pitch of outlet holes is 0.12 to 3 mm. If the pitch is less than 0.12 mm, the intervals between adjacent outlet holes are so small that the production of the paste applicator is difficult. If larger than 3 mm, the control of coating is difficult when a glass substrate with barrier ribs formed at a pitch of 300 μm or less is coated. If the pitch of outlet holes is 3m times (m is an integer of 1 to 10) the pitch of barrier ribs, efficient coating at high precision can be effected. If a paste applicator satisfying the following relation is used, the ease of paste application can be enhanced;

$$L/D = 0.1 \sim 600$$

where L is the length of outlet holes and D is the average diameter of outlet holes.

If L/D exceeds 600, the pressure loss is so large as to keep the quantity of paste application small, to lessen the thickness of the phosphor layer. If less than 0.1, the paste droops loosely from the outlet holes.

For applying the phosphor paste from the outlet holes, it is preferable to continuously apply a pressure of a certain range to the paste, for applying the paste at the pressure. This allows the quantity of the paste applied to be kept constant, and a stable coating thickness can be obtained.

As shown in FIG. 1, while the paste is applied from the outlet holes, the paste applicator and the substrate can be moved relatively each other in parallel to the barrier ribs on the substrate, for coating the substrate with the phosphor paste. In this case, the paste applicator is allowed to travel while the substrate is fixed, or the substrate is allowed to travel while the paste applicator is fixed. Or both of them are allowed to travel simultaneously.

To stop the application of the phosphor paste from the outlet holes of the paste applicator, the paste applicator can be internally kept at a negative pressure, to finish the coating of the paste without liquid drooping at the edge of coating, hence without changing the coating thickness.

If the application of the phosphor paste is started after starting the relative movement of the paste applicator and the glass substrate in parallel to the barrier ribs on the substrate and stopped before the end of the relative movement, the change of the thickness caused by liquid drooping at the edge of coating can be prevented.

In the case of application, it is preferable that the distance between the tips of the outlet holes and the top ends of the barrier ribs is 0.01 to 2 mm. A more preferable range is 0.05 to 0.5 mm. To prevent the contact between the outlet holes and the top ends of the barrier ribs, it is preferable that the distance is 0.01 mm or more, more preferably 0.05 mm or more. Furthermore, to prevent that the paste applied from the outlet holes is disconnected, it is preferable that the distance is 2 mm or less, more preferably 0.5 mm or less.

If a plurality of paste applicators are installed on the apparatus, for simultaneous coating, coating can be completed efficiently in a short time. In this case, if the plurality of paste applicators are moved at the same speed, uniformly thick coating can be achieved. Furthermore, if three or more paste applicators are installed to apply a paste containing a phosphor material emitting light of one color from each of the three or more paste applicators, then phosphor materials of three colors, red, green and blue can be applied at one time for coating. Moreover, it is also possible to apply phosphor pastes of three colors from one paste applicator. In this case, if the shortest distance between the outlet holes applying phosphors respectively different in color is kept at 600 μm or more, the mixing of the phosphor of red, green and blue colors can be prevented.

When a phosphor layer is formed on highly precise barrier ribs, mixing of colors can be prevented by drying after coating of each color.

After a phosphor paste is applied from the outlet holes, water, organic solvent, organic component, etc. can be evaporated or decomposed for removal by heating such as drying or burning, to form a phosphor layer.

In the heating of this case, the phosphor is usually dried with the coating surface turned up, but can also be dried with the coating surface turned down. If the phosphor coating surface is turned down, the phosphor paste runs down along the lateral sides of the barrier ribs, to form a phosphor layer also as the lateral side wall along each barrier rib. If the phosphor layer is formed not only as the bottom wall but also as the lateral side wall along each barrier rib, the area of the phosphor surface can be enlarged, to improve the luminance of the plasma display.

If a photosensitive phosphor paste is used as the phosphor paste, a pattern can be processed by photo lithography. This is effective for removing the phosphor formed by coating on unrequired portions such as the top surfaces of the barrier ribs.

After the photosensitive phosphor pastes of respective red, green and blue colors are applied from the outlet holes for coating, they are exposed through a photo mask, and the pastes on the exposed portions are solubilized or insolubilized by a developer to remove the unrequired portions in the development step, for forming a phosphor layer. The developer can be an organic solvent which can dissolve the organic component in the photosensitive pastes. To the organic solvent, water can also be added by an amount not to lose the dissolving power of the organic solvent. When the photosensitive pastes contain a compound with acidic groups. such as carboxyl groups, an alkali aqueous solution can be used for development. As the alkali aqueous solution, an alkali metal aqueous solution such as sodium hydroxide or calcium hydroxide aqueous solution can be used, but it is preferable to use an organic alkali aqueous solution, since the alkali component can be easily removed at the time of burning.

The organic alkali can be an amine compound. The amine compounds which can be used here include teramethylammonium hydroxide, trimethylbenzylammonium hydroxide, monoethanolamine, diethanolamine, etc. The concentration of the alkali aqueous solution is usually 0.01 to 10 wt %. A preferable range is 0.1 to 5 wt %. If the alkali concentration is too low, it is difficult to remove the non-exposed portions. If the alkali concentration is too high, the pattern may peel and the exposed portions may be corroded unpreferably. It is preferable that the development temperature is 20 to 50° C. in view of process control.

As for the thickness of the phosphor layer, if the thickness (T1) of the phosphor layer as the lateral side wall (at one half of the height of each barrier rib) and the thickness (T2) as the bottom wall satisfy the following relation, a plasma display excellent in luminance can be produced.

$$10 \leqq T1 \leqq 50\ \mu m$$

$$10 \leqq T2 \leqq 50\ \mu m$$

If T1 or T2 is less than 10 μm, the ultraviolet rays generated by electric discharges permeate the phosphor layer, making it difficult to obtain a sufficient luminance. If more than 50 μm, there arises such a problem that the electric discharge voltage becomes high.

It is preferable that T1 and T2 satisfy the following relation:

$$0.2 \leqq T1/T2 < 5$$

If the ratio of the lateral side wall thickness to the bottom wall thickness is too large or too small, the display screen is likely to depend on the angle of visibility, and this is not preferable for obtaining a large screen.

After the phosphor pastes are applied at predetermined positions, they are burned in a burning furnace, to remove the organic component, for forming a phosphor layer. The burning atmosphere and temperature depend on the kinds of the pastes and the substrate. The burning atmosphere is air, nitrogen or hydrogen, etc. A preferable burning temperature is 300 to 550° C. A more preferable range is 350 to 500° C.

If the phosphor are deposited on the top surfaces of the barrier ribs, the barrier ribs may not be able to form sealed cells when the front plate is joined for sealing, and as a result, electric discharge leak can occur. So, the phosphor deposited on the top surfaces can be removed by letting them adhere to an adhesive material.

To perfectly remove the organic component, it is necessary to heat to 300° C., preferably 350° C. However, to prevent the deterioration of the phosphor by heat, the temperature should be 550° C. or lower, preferably 500° C. or lower. As the burning furnace, a batch type burning furnace or belt type or roller hearth type continuous burning furnace can be used.

The substrate with a phosphor layer formed like this is joined with the front and rear glass substrates for sealing. The front substrate has an electric discharge maintaining electrode consisting of ITO and bus electrode, a glass layer as a dielectric, and a protective film for protecting the dielectric from electric discharges (usually magnesium oxide) respectively formed on it. As required, a color filter and black matrix or black stripes are formed. The front and rear plates are sealed using glass frit, etc.

Subsequently, a rare gas such as helium, neon or xenon is injected between the front and rear plates, to produce the panel portion of a plasma display. Furthermore, a driver IC is mounted, to produce a plasma display. Then, the electrodes of the front and rear plates are matrix-driven, to allow displaying.

The apparatus for phosphor paste coating is described below. The apparatus for producing a plasma display of the present invention is composed of a table to be mounted with a substrate with a plurality of barrier ribs and a paste applicator with a plurality of outlet holes corresponding to the spaces formed between the respectively adjacent barrier ribs on the substrate for forming stripes of the phosphor pastes on the spaces between the respectively adjacent barrier ribs.

Figure 3:
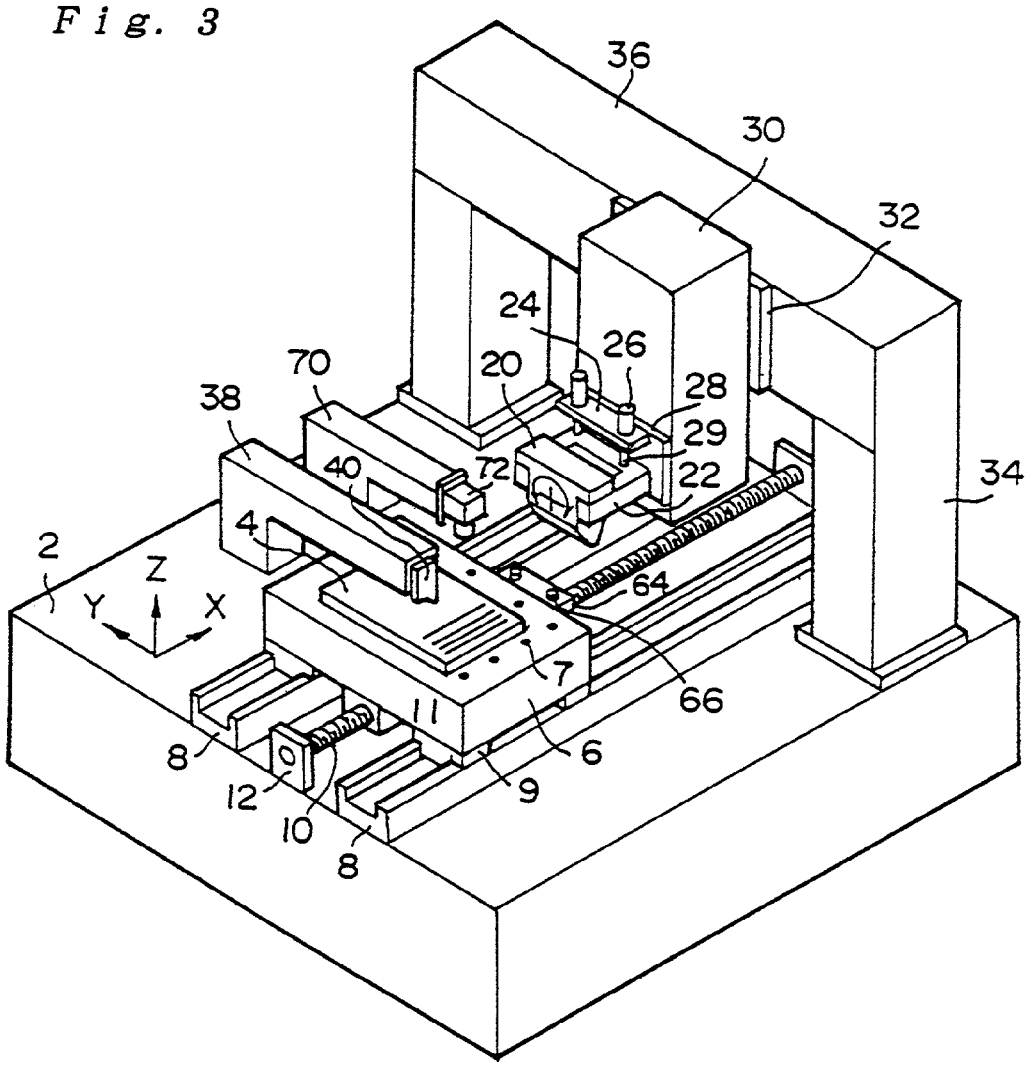
FIG. 3. is a schematic general perspective view showing one example of the plasma display producing apparatus.
Figure 4:
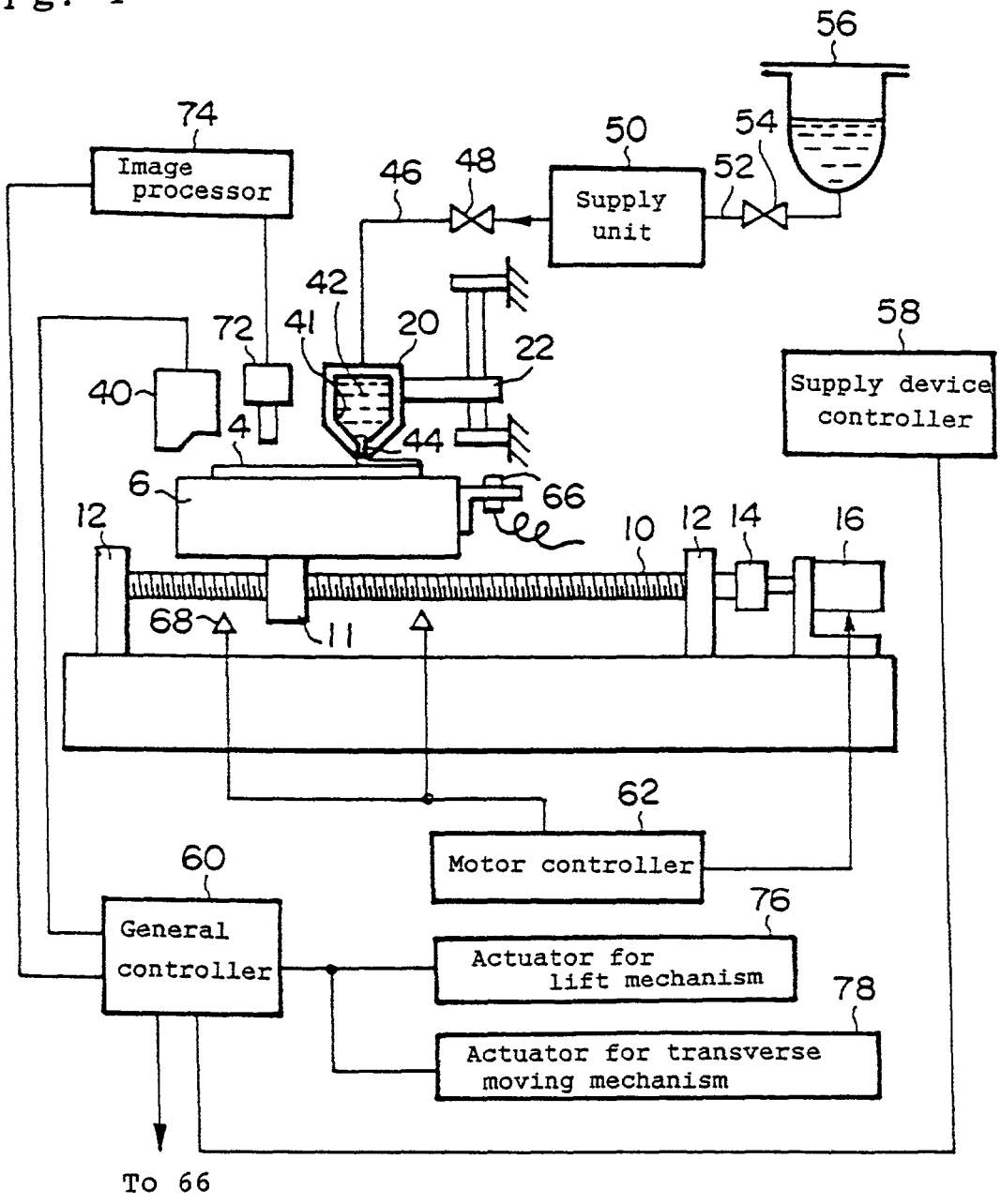
FIG. 4 is a schematic drawing for illustrating an important portion of the plasma display producing apparatus shown in FIG. 3.

FIG. 3 is a general perspective view showing the apparatus for producing a plasma display as an embodiment. FIG. 4 is a schematic drawing showing the table 6 and the paste applicator 20 of FIG. 3, for illustrating an important portion of the production apparatus.

In FIGS. 3 and 4, on a base 2, a pair of grooved guide rails 8 are provided, and on the grooved guide rails 8, the table 6 is arranged. The table 6 has a plurality of suction holes 7, and a substrate 4 with barrier ribs provided at a certain pitch is fixed on the surface of the table 6 by vacuum suction. The substrate 4 is lifted and lowered on the table 6 by lift pins not illustrated. Furthermore, the table 6 can reciprocate in the X-axis direction on the grooved guide rails 8 through slide stands 9.

Between the pair of grooved guide rails 8, a feed screw 10 extends through a nut type connector 11 fixed on the underside of the table 6. The feed screw 10 is rotatably supported by bearings 12 at both the ends, and is connected with an AC servo motor 16 at one end.

Above the table 6, the paste applicator 20 for applying a phosphor paste is connected to a lift mechanism 30 and a transverse moving mechanism 36 through a holder 22. The lift mechanism 30 is provided with a lift bracket 28 capable of ascending and descending, and the lift bracket 28 is ascendably and descendably installed along a pair of guide rods in the casing of the lift mechanism 30. Furthermore, in the casing, a ball screw as a feed screw (not illustrated) is rotatably arranged between the guide rods, and connected with the lift bracket 28 through a nut type connector. Moreover, at the top end of the feed screw not illustrated, an AC servo motor is connected, so that the lift bracket 28 can be lifted or lowered as desired by the rotation of the AC servo motor.

The lift mechanism 30 is connected with a transverse moving mechanism 36 through a Y-axis moving bracket 32. The transverse moving mechanism 36 is provided to reciprocate the Y-axis moving bracket 32 in the Y-axis direction. The guide rods, feed screw, nut type connector, AC servo motor, etc. necessary for the action are arranged in a casing as in the lift mechanism 30. The transverse moving mechanism 36 is fixed on the base 2 by pillars 34.

In this constitution, the paste applicator 20 can be moved in the Z-axis and Y-axis directions. The paste applicator 20 extends in the direction perpendicular to the reciprocating direction of the table 6, i.e., horizontally in the Y-axis direction. The holder 22 for directly holding it is rotatably supported in the lift bracket 28, and can be rotated in a vertical plane as desired in the arrow directions of FIG. 3.

A horizontal bar 24 located above the holder 22 is also fixed to the lift bracket 28. At both the ends of the horizontal bar 24, electromagnetic linear actuators 26 are installed. The linear actuators 26 have expansion rods 29 protruding from the underside of the horizontal bar 24, and the expansion rods 29 contact both the ends of the holder 22, to control the rotating angle of the holder 22, so that the inclination of the paste applicator 20 can be set as desired.

On the top surface of the base 2, an inverse L-shaped sensor support 38 and an inverse L-shaped camera support 70 are fixed. At the tip of the sensor support 38, a height sensor 40 for measuring the heights of the top ends of the barrier ribs on the surface of the substrate 4 on the table 6 is installed. Furthermore, at One end of the table 6, position sensors 66 are installed through a sensor bracket 64, to detect the positions of the bottom end faces of the outlet holes of the paste applicator 20 in reference to the table 6 in the vertical direction.

At the tip of the camera support 70, a camera 72 is installed to detect the positions of the barrier ribs or the spaces between the barrier ribs on the surface of the substrate 4 or a reference mark located at any other place than the barrier ribs. As shown in FIG. 4, the camera 72 is electrically connected to an image processor 74 and can quantitatively identify the positions of the barrier ribs or the spaces between the partitions of the substrate, the number of the spaces between the barrier ribs, and the position of the reference mark.

In FIG. 4, the paste applicator 20 has a manifold 41 which is filled with a phosphor paste 42. From outlet holes 44, the phosphor paste is applied. The paste applicator 20 is connected with a supply hose 46, being further connected with an electromagnetic change-over valve 48 for application, supply unit 50, suction hose 52, electromagnetic change-over valve 54 for suction and phosphor paste tank 56. The phosphor paste tank 56 stores the phosphor paste 42.

The supply unit 50 can be a piston type or diaphragm type fixed displacement pump, turbine pump, gear pump, or pressure feed controller for extruding a liquid by gas pressure, etc.

Receiving a control signal from a supply device controller 58, the supply unit 50 and the respective electromagnetic change-over valves are actuated to suck the phosphor paste 42 from the phosphor paste tank 56 for supplying it to the paste applicator 20.

The supply device controller 58 is further electrically connected with a general controller 60. The general controller 60 is electrically connected with all the control information such as the inputs from a motor controller 62, the height sensor 40, the image processor 74 of the camera 72, a lift mechanism actuator 76 and a transverse moving mechanism actuator 78, and dispose of the sequence control of the whole. The general controller 60 can be of any mechanism such as a computer or sequencer, as far as it has control function.

Furthermore, the motor controller 62 receives the signals of the AC servo motor 16 for driving the table 6, the signals of the AC servo motors for the lift mechanism 30 and the transverse moving mechanism 36, the signals from the position sensor 68 for detecting the traveling position of the table 6, the signals from the respective linear sensors (not illustrated) for the Y and Z axes for detecting the action position of the paste applicator 20, etc. Instead of using the position sensor 68, an encoder can be incorporated in the AC servo motor 16, to detect the position of the table 6 based on the pulse signals delivered from the encoder.

The method for applying a phosphor paste using this plasma display producing apparatus is described below.

At first, if the respective acting portions return to their home positions, the table 6 and the paste applicator 20 travel to their respective standby positions. In this case, the portion from the phosphor paste tank 56 to the paste applicator 20 is already filled with the phosphor paste, and the electromagnetic change-over valve 48 for application is opened while the electromagnetic change-over valve 54 for suction is closed. On the surface of the table 6, the lift pins not illustrated ascend, and the substrate 4 is mounted at the tops of the lift pins by a loader not illustrated.

Then, the lift pins are lowered, to mount the substrate 4 on the surface of the table, and positioned on the table 6 by an alignment device not illustrated, being attracted by vacuum suction.

Subsequently, the table 6 travels till the barrier ribs of the substrate 4 come under the camera 72 and the height sensor 41, and stops. The camera 72 is adjusted in position beforehand to transmit the image of the ends of the barrier ribs on the substrate 4 positioned on the table 6, and detects the position of the space between the barrier ribs at the extreme end by image processing, obtaining the distance from the reference point of the camera 72. On the other hand, the distance between the reference point of the camera and the outlet hole 44 located at the extreme end of the paste applicator 20 in the predetermined Y-axis ordinate position is measured at the time of preliminary adjustment and stored in the general controller 60 as information. Therefore, if the distance between the reference point of the camera and the space between the barrier ribs is transmitted to the image processor 7, the Y-axis ordinate value at which the outlet hole 44 at the extreme end of the paste applicator 20 is located above the space between the barrier ribs at the ends of the barrier ribs is calculated, to let the paste applicator 20 travel to the position. As a result, the centers of all the outlet holes. of the paste applicator 20 are positioned above the respective spaces between the barrier ribs to be coated with the phosphor paste, to complete the relative positioning between the paste applicator 20 and the substrate 4.

As another positioning method, the camera 72 can also detect the reference mark located at any other place than the barrier ribs on the substrate 4. The distance between the reference point of the camera and the outlet hole 44 located at the extreme end of the paste applicator 20, and the distances between the reference mark and the ends of the spaces between the barrier ribs to be coated are measured at the time of preliminary adjustment, and are stored in the general controller 60 as information. Therefore, if the distance between the reference point of the camera and the reference mark is transmitted to the image processor 74, the paste applicator 20 is driven to travel to the position for coating.

Furthermore, the distances between the reference point of the camera and the outlet holes of the paste applicator 20 can also be obtained by applying the phosphor paste from the paste applicator 20 onto the substrate flat and smooth on the surface, to form stripes of the phosphor paste, and detecting and measuring the positions of the stripes by image processing, to obtain the absolute positions. Thus, since the positions of the outlet holes of the paste applicator 20 can be known, the absolute position of the paste applicator can be obtained as a result. This method allows the outlet holes of the paste applicator 20 to suit the spaces between the partitions on the surface of the substrate 4, to allow coating.

The height sensor 40 detects the position of the top ends of the barrier ribs of the substrate 4 in the vertical direction, and calculates the height of the top ends of the barrier ribs of the substrate 4 from the difference between the detected position and the position of the top surface of the table. To the height, the predetermined distance from the outlet holes of the paste applicator 20 to the top ends of the barrier ribs of the substrate 4 is added, to calculate the distance for the paste applicator 20 to descend on the Z-axis linear sensor, and the paste applicator 20 is driven to travel to the position. Thus, even if the position of the top ends of the barrier ribs of the substrate 4 on the table 6 changes with every substrate, the distance between the outlet holes of the paste applicator 20 and the top ends of the barrier ribs of the substrate 4 important for coating can be kept always constant.

The height sensor 40 can be of any principle to allow measurement, such as non-contact type using a laser or ultrasonic waves, etc. or contact type using a dial gauge or differential transformer, etc.

Then, the table 6 is moved toward the paste applicator 20, and accelerated to a predetermined coating speed before the coating start position of the substrate 4 reaches the position below the outlet holes of the paste applicator 20. The distance between the movement start position of the table and the coating start position must be long enough to allow the table 6 to be accelerated to the coating speed.

At a place before the coating start position of the substrate comes to the position below the outlet holes of the paste applicator 20, the position sensor 68 for detecting the position of the table 6 is arranged, and if the table 6 reaches the position, the supply unit starts action, to start the application of the phosphor paste 42 to the paste applicator 20. Instead of the position sensor 68, an encoder can be connected to the motor or feed screw, to detect the position in reference to the value of the encoder.

The application of the phosphor paste is continued till the coating end position of the substrate 4 comes to the position near below the outlet holes of the paste applicator 20. That is, since the substrate 4 is always located at a determined position on the table 6, a position sensor or its encoder value is preset at the position of the table 6 corresponding to the position at which the coating end position of the substrate is right below the outlet holes, and if the table 6 comes to the corresponding position, a stop command is given from the general controller 60 to the supply device controller 58, to stop the application of the fluorescent paste 42 to the paste applicator 20. In this case, the paste applicator 20 can be raised, to perfectly stop the supply of the phosphor paste.

If the phosphor paste 42 is a liquid with a relatively high viscosity, it is difficult to instantaneously stop the discharge from the outlet holes of the paste applicator 20 by the action of the remaining pressure. So, as soon as the supply of the phosphor paste 42 is stopped, the pressure of the manifold 41 of the paste applicator 20 is returned to atmospheric pressure, or changed to a negative pressure, to suck the phosphor paste from the outlet holes of the paste applicator 20, for allowing the application of the phosphor paste from the outlet holes to be stopped in a short time. As for the means to change the pressure of the manifold 41 to a negative pressure, if the supply unit 50 is a pump, the pump can be operated reversely, that is, in the direction to suck the phosphor paste. In the case of pressure feed, the supply unit 50 can be connected with a vacuum source, to change the pressure of the manifold 41 to a negative pressure.

As a further other means for changing the pressure of the manifold 41 to a negative pressure, an electromagnetic change-over valve connected with a vacuum source can also be provided at a position between the electromagnetic change-over valve 48 for discharge and the paste applicator 20, or in the paste applicator 20 itself, to change the pressure to a negative pressure. In this case, if the pressure of the vacuum source can be adjusted from the atmospheric pressure to a desired negative pressure, the speed at which the phosphor paste 42 is sucked from the outlet holes can be adjusted. The vacuum source can be a vacuum pump, aspirator or piston type pump capable of being operated reversely.

Furthermore, the timing of the pressure adjustment can be controlled by the supply device controller 58 and the general controller 60.

The table 6 continues traveling even after the coating end position is passed, and stops only when it reaches the terminal point. In this case, if portions to be coated still remain, the paste applicator 20 is moved in the Y-axis direction to the next coating start position, and thereafter, coating is effected according to the same procedure except that the table 6 is driven to travel in the reverse direction. When coating is to be effected by letting the table 6 travel in the same direction as that of the first time, the paste applicator 20 is moved in the Y-axis direction till the next coating start position, and the table 6 is returned to the X-axis preparatory position.

After the coating process has been completed in this way, the table 6 is driven to travel to and stop at the place where the substrate 4 is unloaded by an unloader, and the attraction of the substrate 4 by suction is released with the vacuum opened to the atmosphere, and the lift pins are raised, to separate the substrate 4 from the surface of the table 6, for lifting it.

At this time, the substrate 4 is held on the underside by an unloader not illustrated, and carried to the subsequent step of process. After the substrate 4 is transferred to the unloader, the table 6 is returned to the home position, with the lift pins lowered.

At this time, the electromagnetic change-over valve 48 for application is closed, while the electromagnetic change-over valve 54 for suction is opened, to actuate the supply unit 50, for supplying the phosphor paste 42 to the paste applicator 20 from the phosphor paste tank 56 by an amount necessary for one substrate.

In the above coating process, to improve the coating thickness accuracy in the given effective area, the timing for starting the. supply of the phosphor paste to the paste applicator 20 at the coating start position and the timing for stopping the application of the phosphor paste to the paste applicator 20 at the coating end position are important. So, the respective actions must be effected at the optimum points.

In this example, after the distance between the outlet holes of the paste applicator 20 and the top ends of the barrier ribs of the substrate 4 has been set, the application of the phosphor paste 42 is started. The reason is that if the application of the phosphor paste 42 is started before the distance between both is set, the phosphor paste 42 spreads at the tip faces of the outlet holes when it is applied from the outlet holes, to contaminate other portions than the outlet holes, and that in an extreme case, the potions of the phosphor paste 42 applied from the adjacent outlet holes join disadvantageously, not allowing highly accurate coating. If the application of the phosphor paste 42 is started after the tip faces of the outlet holes of the paste applicator 20 have been brought close to the substrate 4, the phosphor paste 42 is guided into the spaces between the respectively adjacent barrier ribs before the phosphor paste 42 is spread at the tip faces. So, the inconvenience as described above does not happen.

Furthermore, this example describes an application case where the substrate 4 travels in the X-axis direction while the paste applicator 20 travels in the Y-axis and Z-axis directions. However, the table and the paste applicator can be of any traveling style, as far as the structure or style allows the paste applicator 20 and the substrate 4 to travel relatively three-dimensionally.

The above detailed description covers a case of coating with one phosphor paste, but the apparatus can also be applied to a case where the three phosphors of red, blue and green can be simultaneously applied for coating.

Figure 5:
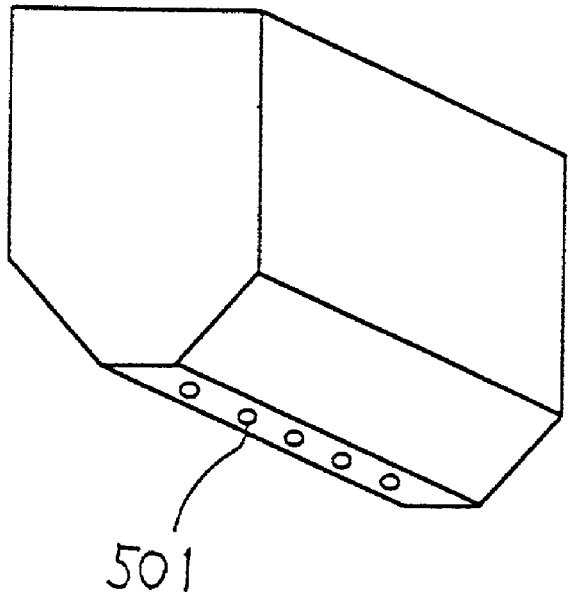
FIG. 5. is a perspective view showing an example of the paste applicator.
Figure 6:
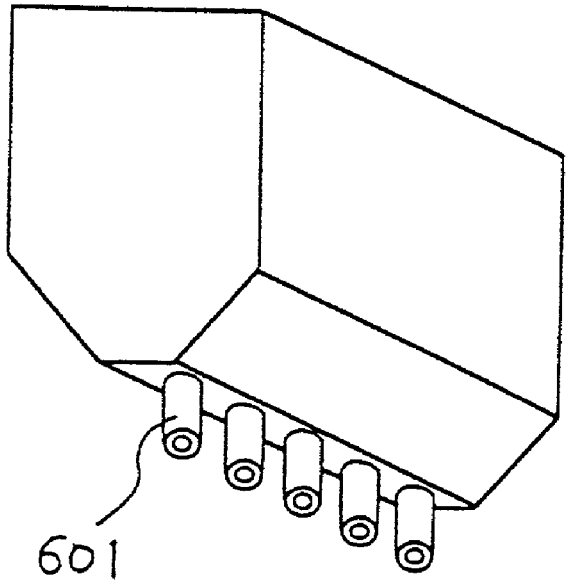
FIG. 6. is a perspective view showing another example of the paste applicator.

FIGS. 5 and 6 are schematic perspective views showing examples of the paste applicator In FIG. 5, holes with a certain diameter are provided as outlet holes 501 in a flat surface. Furthermore, the outlet holes can be formed by arranging pipes 601 with the same form as shown in FIG. 6, and this paste applicator is preferable since the paste applicator is less likely to be contaminated.

It is preferable that the centers of all the outlet holes of the paste applicator are arranged to positions above the respective spaces between the barrier ribs to be coated with the phosphor paste.

It is also preferable that the average diameter of the outlet holes of the paste applicator is 10 μm to 500 μm, and not larger than the spaces between the barrier ribs, and this prevents the mixing of adjacent colors.

The outlet holes of the paste applicator are not necessarily required to be circular, and the length of the openings in the direction almost perpendicular to the barrier ribs can be 10 μm to 500 μm, being smaller than the spaces between the barrier ribs. The outlet holes in this case can be oblong, ellipsoidal or rectangular, etc. If the faces and/or inner walls of the outlet holes of the paste applicator are coated with a fluorine based resin film such as polytetrafluoroethylene, the phosphor paste can be released better from the faces and/or inner walls of the outlet holes, and the contamination of the faces of the outlet holes can also be prevented.

Furthermore, if the faces and/or inner walls of the outlet holes of the paste applicator are coated with an amorphous carbon film (DLC), the surface hardness of the faces and/or inner walls of the outlet holes can be enhanced, to improve wear resistance.

Figure 7:
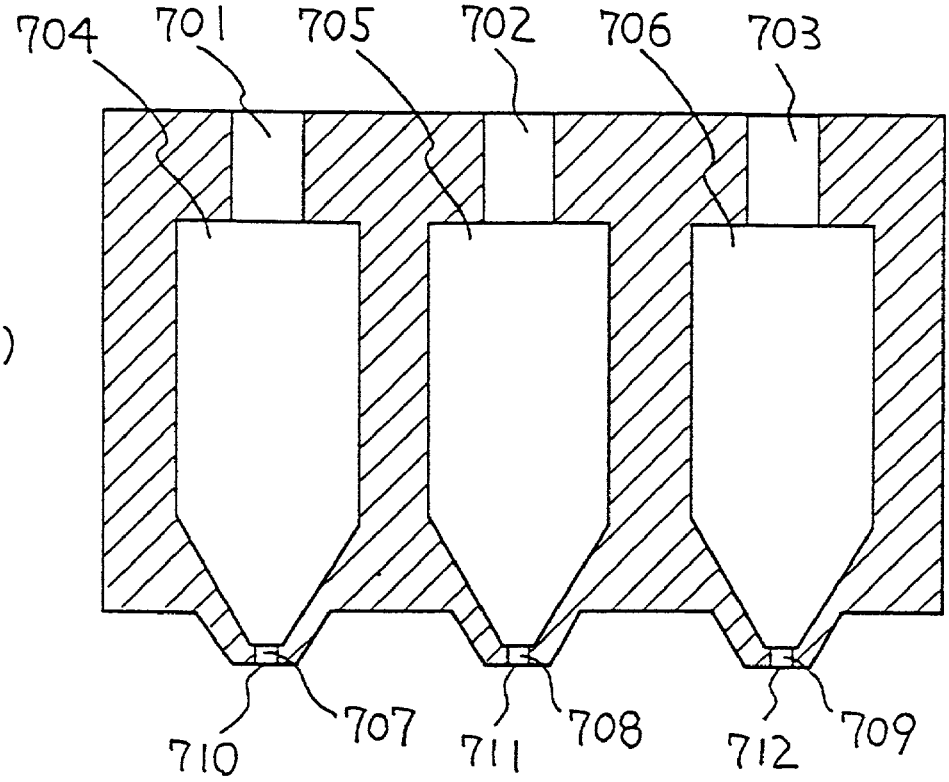
FIG. 7. is a sectional view and bottom view showing a further other example of the paste applicator.
Figure 7:
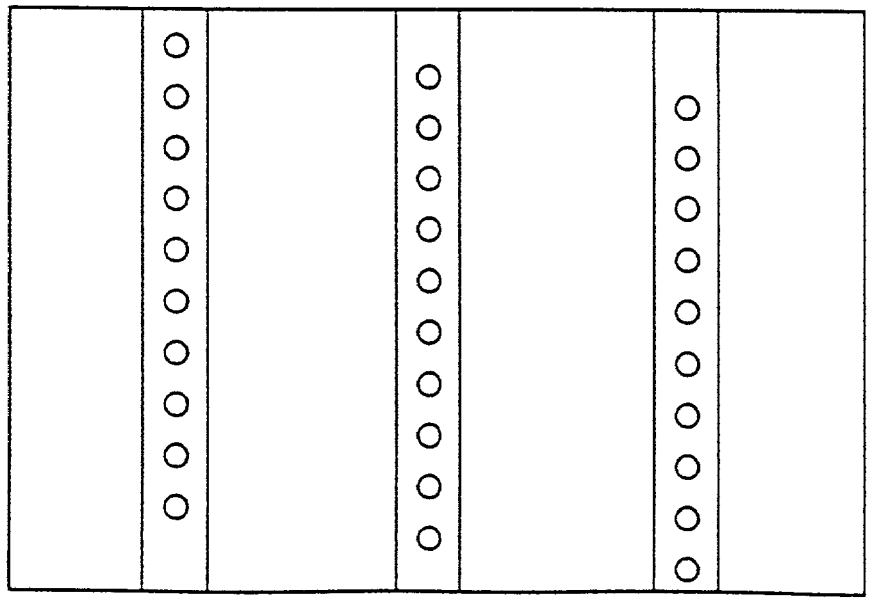

FIG. 7 is a sectional view and bottom view showing a further other example of the paste Applicator. One paste applicator has a plurality of phosphor paste storage sections 704, 705 and 706, phosphor paste supply ports 701, 702 and 703 for supplying phosphor pastes to the phosphor paste storage sections 704, 705 and 706, and passages 707, 708 and 709 for connecting the storage sections 704, 705 and 706 with outlet holes 710, 711 and 712 respectively. Furthermore, as shown in the bottom view, the number of the outlet holes 710, 711 and 712 is larger than that of the storage sections 704, 705 and 706, and the respective outlet holes 710, 711 and 712 are arranged on straight lines respectively. This allows different phosphor pastes to be applied from one paste applicator. The shortest distance between the outlet holes for applying phosphor pastes different in color is 600 μm or more, to prevent the mixing of different colors.

Figure 8:
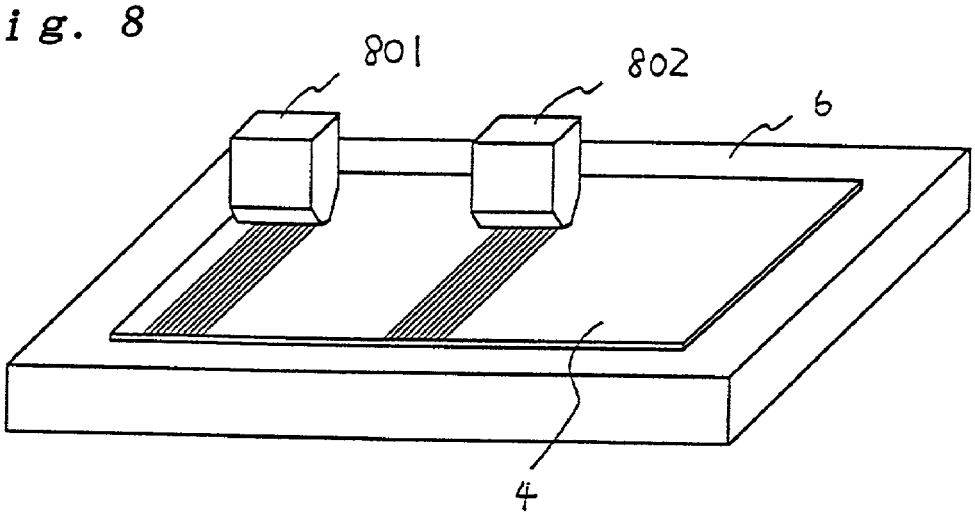
FIG. 8. is a perspective view showing an example of the plasma display producing apparatus.

FIG. 8 is a schematic perspective view for illustrating an important portion of the plasma display producing apparatus as a further example. Instead of arranging one paste applicator, two or more paste applicators can be arranged in the Y direction. The paste applicators 801 and 802 are driven by a controller not illustrated, in the X and Y directions synchronously or non-synchronously. If two or more paste applicators are used like this, to coat the substrate 4 on the table 6 with the phosphor paste(s), the coating time can be shortened.

In this case, the two or more paste applicators can apply a phosphor paste emitting light of the same color, or can apply phosphor pastes emitting light of two or more different colors.

It is preferable in view of efficiency that the two or more paste applicators are located apart from each other in the direction perpendicular to the barrier ribs by an integer times the space between the adjacent barrier ribs, and that when the difference in location between the adjacent paste applicators is less than the external width of each paste applicator, they are located apart from each other in the direction parallel to the barrier ribs.

If three such paste applicators for red, green and blue phosphor pastes are arranged in series, a three-color phosphor layer can be efficiently formed in the spaces between the barrier ribs.

Figure 9:
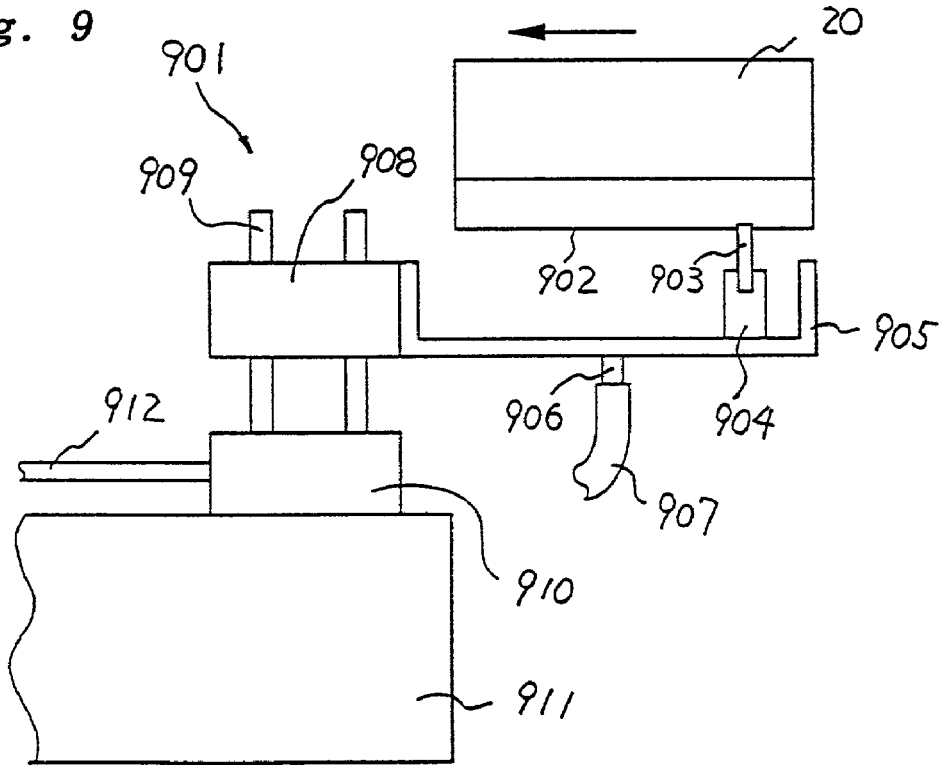
FIG. 9. is a side view showing a device for cleaning the outlet holes faces of the paste applicator in the plasma display producing apparatus.

FIG. 9 is a schematic side view showing a device for cleaning the faces of outlet holes of a paste applicator.

A cleaning device 901 is arranged so that a wiping member 903 may contact a outlet hole face 902 of a paste applicator 20. The wiping member 903 is formed to wrap the tip of the outlet hole face, but can also be formed to contact only the outlet hole face 902. The wiping member 903 is fixed on a bracket 904 installed in a tray 905, and moves in the transverse direction (Y-axis direction) together with the tray 905. While the wiping member 903 moves in the transverse direction in contact with the outlet hole face 902, the phosphor paste deposited on the outlet hole face is scrapped off. The scraped off phosphor paste is guided from a drain port 906 through a tube 907 connected to it, into a waste paste tank not illustrated. If the scraped off phosphor paste does not reach the waste paste tank by gravity only, it is desirable to use a vacuum source such as a vacuum pump for suction. The wiping member 903 is located at a position on the right of the openings of the paste applicator 20 when the tray 905 reaches the extreme right position of FIG. 9, where the wiping member 903 is kept away from the phosphor paste applied from the paste applicator 20. Furthermore, the tray 905 has a size capable of collecting all the phosphor paste applied from the paste applicator 20.

Moreover, the tray 905 is connected to a lift section 908. The lift section 908 is lifted and lowered vertically by an air cylinder not illustrated along guides 909 above a moving unit 910. When the lift section 908 is located at the lowest point, the wiping member 903 is also located at the lowest point, and kept away from the outlet hole face 902 of the paste applicator 20 by a certain distance, without contacting it. The lift section 908 is adjusted so that the wiping member 903 may rise to contact the outlet hole face 902 of the paste applicator 20.

The moving unit 910 is driven by a ball screw 912 along a guide not illustrated on a mount 911, to move in the transverse direction. The ball screw 912 is connected with a servo motor not illustrated, and can be actuated as desired by control of the motor.

The wiping member 903 can be made of any material, but it is desirable that it is made of a resin or rubber, not to flaw the outlet hole face of the paste applicator. The material can be selected, considering the chemical resistance against the phosphor paste.

The coating sequence with the use of the wiping device 901 is as described below. At first, with the wiping member 903 located at the lowest point, the tray 905 is moved to a position below the paste applicator 20, and the phosphor paste supply device is actuated, to apply the phosphor paste from the paste applicator 20, for bleeding. After completion of bleeding, the lift section 908 is lifted, to let the wiping member 903 contact the outlet hole face 902 of the paste applicator 20. Then, the servo motor not illustrated is driven, to move the wiping member 903 in the transverse direction leftward in FIG. 9, to wipe off the phosphor paste deposited on. the outlet hole face 902. Subsequently, the paste applicator 20 is moved to a predetermined position, to coat the spaces between the barrier ribs with the phosphor paste.

The wiping action can be effected whenever the coating of the spaces between the barrier ribs with the phosphor paste is completed, or after the coating is carried out several times. The timing of wiping action depends on the degree of the deposition of the fluorescent paste on the outlet hole face 902.

The wiping action allows coating work to be effected with the outlet hole face of the paste applicator kept cleaned. So, such inconveniences that the phosphor paste is deposited on the top ends of the barrier ribs of the substrate and that the phosphor paste is applied to the spaces between the barrier ribs adjacent to the spaces between the barrier ribs to be coated can be prevented, and the phosphor paste can be uniformly and stably applied to the spaces between the barrier ribs.

It is preferable to provide a means for removing the phosphor paste deposited on any other portions than the predetermined coating positions such as the top ends of the barrier ribs.

The phosphor paste can be removed by such a means as spatulas for scraping off, or letting an adhesive material contact the top ends of the barrier ribs, or blowing compressed air from air nozzles. The adhesive material is not especially limited as far as it has said property, and can be selected, for example, from polyurethane rubber, polyethylene rubber, silicone rubber or any of their gels.

The form of the adhesive material is not especially limited, but it is preferable that the adhesive material is a belt or roller with a form to contact the surface of the substrate. It is preferable that the belt contacts the substrate which is being carried while rotating between a delivery roll and a take-up roll. The contact allows the phosphor paste on the top ends of the barrier ribs to be removed by sticking.

EXAMPLES

The apparatus and method is described below concretely in reference to examples, but is not limited thereto or thereby. In the following examples and comparative examples, "%" is "wt %" unless otherwise specified. The formed phosphor layer was evaluated in reference to the following seven items.

- Paste dischargeability from outlet holes
- Coating time (total time taken for phosphor paste coating (excluding drying time))
- Side wall thickness (average of the thicknesses at nine places in one plane at the center of the height of each barrier rib)
- Bottom thickness (average of the thicknesses at nine places in one plane on the dielectric layer)
- Thickness distribution (difference between the maximum thickness and the minimum thickness in measurement at nine places)
- Whether or not the paste is deposited on the top ends of barrier ribs
- Mixing of colors (leak of phosphor paste onto the spaces between the barrier ribs adjacent to the spaces between the barrier ribs to be coated)

Example 1

A 340 mm wide ×440 mm deep ×2.8 mm thick soda glass substrate fully screen-printed with a photosensitive silver paste with a thickness of 5 μm was exposed using a photo mask, developed and burned, to form 1920 silver electrodes as stripes at a pitch of 220 μm. A glass paste consisting of a glass and a binder was screen-printed over the electrodes on the substrate, and burned to form a dielectric layer. Subsequently, a photosensitive glass paste consisting of a glass powder and a photosensitive organic component was further screen-printed, with a thickness of 200 μm, and dried. Then, a photo mask designed to form barrier ribs between the respectively adjacent electrodes was used for exposure, and development and burning were effected, to form barrier ribs. Thus, 1921 barrier ribs with a width of 30 μm and a height of 130 μm were formed at a pitch of 220 μm.

The glass substrate with barrier ribs formed like this was coated with the phosphor pastes composed as follows, using an apparatus shown in FIG. 3.

Phosphor pastes: Forty grams of any of the following phosphor powders was mixed with 10 g of ethyl cellulose, 10 g of terpineol and 40 g of benzyl alcohol, and the mixture was kneaded by a ceramic three-roller mill, to produce a phosphor paste of red, green or blue.

Phosphor powders:

Red: $(Y, Gd, Eu)BO_3$ 2.5 μm in the grain size of 50 vol % of the powder, and 2.3 $m_2/g$ in specific surface area Green: $(Zn, Mn)_2SiO_4$ 2.9 μm in the grain size of 50 vol % of the powder, and 1.8 $m^2/g$ in specific surface area Blue: $(Ba, Eu)MgAl_{10}O_{17}$ 3.1 μm in the grain size of 50 vol % of the powder, and 2.5 $m^2/g$ in specific surface area The viscosities of the obtained phosphor pastes were respectively 14 Pa·s (red), 18 Pa·s (green) and 15 Pa·s (blue).

One paste applicator with 64 outlet holes with an average diameter of 150 μm formed at a pitch of 660 μm and with a length of 2 mm was used for applying the phosphor pastes.

The red phosphor paste and the paste applicator were used for coating while the distance between the top ends of the barrier ribs formed on the glass substrate and the tips of the outlet holes of the paste applicator was kept at 0.1 mm. During the coating, the paste applicator filled with the phosphor paste was pressurized for continuous application, and moved at a speed of 50 mm/sec parallel to the barrier ribs.

After start of coating, a pressure of 2.6 $kg/cm^2$ was applied in the case of red or blue, or a pressure of 3 $kg/cm^2$ was applied in the case of green, and when the paste applicator progressed to the end of the substrate, coating was terminated. In this case, at 0.1 second before the paste applicator reached the ends of barrier ribs, a negative pressure was applied to reduce the pressure in the paste applicator. Then, the paste applicator was moved by 42.24 mm in the direction perpendicular to the partitions, and the phosphor paste was applied. By 10 times of coating, 640 lines were formed in every three spaces between the respectively adjacent barrier ribs. Then, the coating was dried at 80° C. for 15 minutes. Similarly, every space between the barrier ribs on the immediate right of each space coated with the red phosphor paste was coated with the green phosphor paste, and every space between the barrier ribs on the immediate left of each space coated with the red phosphor paste was coated with the blue phosphor paste.

The substrate coated with the red, green and blue phosphor pastes was burned at 460° C. for 15 minutes, and evaluated. The evaluation results are shown in Table 1.

Example 2

A phosphor layer was formed as described in Example 1, except that two paste applicators were used instead of one paste applicator and moved at 50 mm/sec. The evaluation results are shown in Table 1.

Example 3

A phosphor layer was formed as described in Example 1, except that three paste applicators respectively filled with any of the red, green and blue phosphor pastes were used instead of one paste applicator, for coating. The evaluation results are shown in Table 1.

Example 4

A phosphor layer was formed as described in Example 1, except that the number of outlet holes was 640, instead of 64, and that the coating with one-color phosphor paste was completed by one time of paste applicator movement. The evaluation results are shown in Table 1.

Example 5

A phosphor material layer was formed as described in Example 1, except that a substrate with electrodes formed at a pitch of 120 μm and with barrier ribs of 30 μm in width and 90 μm in height formed at a pitch of 120 μm was used, and that a paste applicator with outlet holes with a diameter of 75 μm formed at a pitch of 720 μm was used for coating once and moved by 0.36 mm, 46.08 mm, 0.36 mm, 46.08 mm, 0.36 mm, 46.08 mm, 0.36 mm, 46.08 mm and 0.36 mm for coating 10 times in total. The evaluation results are shown in Table 1.

Example 6

A phosphor layer was formed as described in Example 1, except that a substrate with electrodes formed at a pitch of 120 μm and with barrier ribs of 30 μm in width and 90 μm in height formed at a pitch of 120 μm was used, and that a paste applicator with outlet holes with a diameter of 150 μm formed at a pitch of 720 μm was used for coating once and moved by 0.36 mm, 46.08 mm, 0.36 mm, 46.08 mm, 0.36 mm, 46.08 mm, 0.36 mm, 46.08 mm and 0.36 mm for coating 10 times in total. Furthermore, after the phosphor layer was burned, an adhesive roller with a width of 500 mm and a diameter of 250 mm was rolled so that the entire top ends of the barrier ribs might contact the roller. The evaluation results are shown in Table 1.

Example 7

Phosphor pastes composed as follows were applied as described in Example 5, and the coating was exposed using a photo mask with 1920 open lines with a width of 80 μm at a pitch of 120 μm. Then, it was developed by 0.5 wt % triethanolamine aqueous solution and burned to form a phosphor layer. The evaluation results are shown in Table 1.

Phosphor pastes: Fifty grams of any of the following phosphor powders was mixed with 20 g of a binder (1:1 copolymer of isobutyl methacrylate:acrylic acid, with a weight average molecular weight of 24,000), 15 g of a photosensitive monomer (trimethylolpropane triacrylate), 20 g of gamma-butyrolactone and 3 g of a polymerization initiator (Irgacure 907 produced by Ciba Geigy), and the mixture was kneaded by a three-roller mill, to prepare a paste.

Phosphor powders:

Red: (Y, Gd, Eu)$BO_3$ 2.5 μm in the grain size of 50 vol % of the powder, and 2.3 $m^2/g$ in specific surface area Green: $(Zn, Mn)_2SiO_4$ 2.9 μm in the grain size of 50 vol % of the powder, and 1.8 $m^2/g$ in specific surface area Blue: (Ba, Eu)$MgAl_{10}O_{17}$ 3.1 μm in the grain size of 50 vol% of the powder, and 2.5 $m^2/g$ in specific surface area The viscosities of the obtained fluorescent pastes were respectively 20 Pa·s (red), 32 Pa·s (green) and 19 Pa·s (blue).

Example 8

Phosphor pastes composed of 50 g of a phosphor powder, 40 g of a binder polymer (a photosensitive polymer with a weight average molecular weight of 43,000 and an acid value of 95 obtained by letting 0.4 equivalent of glycidyl methacrylate addition-react with each equivalent of the carboxyl groups of a copolymer produced by 40% of methacrylic acid, 30% of methyl methacrylate and 30% of styrene), 30 g of a solvent (γ-bytrolactone) and 4 g of a dispersing agent were used instead of those of Example 1. The respective ingredients of the organic component were heated at 80° C. for dissolution, and then a fluorescent powder was added. The mixture was kneaded by a kneader, to produce a paste. The viscosities of all the phosphor pastes (red, green and blue) were 0.05 Pa·s.

A phosphor layer was formed as described in Example 1, except that a glass substrate with 2000 barrier ribs with a height of 120 μm and a width of 30 μm formed at a pitch of 150 μm was used, that a paste applicator with 640 outlet holes with a diameter of 80 μm formed at a pitch of 450 μm was used[. Accordingly, the applicator had 639 intervals between the holes, and the length of the line of holes was 639 ×the pitch of 450 μm, which is 287.550 mm. The], and that the discharge of the red phosphor paste was followed by drying at 80° C. for 60 minutes with the coating face down, discharging the green phosphor paste, drying at 80° C. for 60 minutes with the coating face down, discharging the blue phosphor paste, drying at 80° C. for 60 minutes with the coating face down, and burning at 500° C. for 30 minutes. The evaluation results are shown in Table 1.

Example 9

Phosphor pastes were produced as described in Example 8, except that phosphor pastes composed of 50 g of a phosphor powder, 40 g of a binder polymer, 30 g of a solvent (γ-butyrolactone) and 4 g of a dispersing agent, respectively with a viscosity of 0.03 Pa·s (red, green and blue) were used.

A phosphor layer was formed as described in Example 8, except that a glass substrate with 2000 barrier ribs with a height of 140 μm and a width of 50 μm formed at a pitch of 360 μm, that a paste applicator with 1940 outlet holes with a diameter of 100 μm formed at a pitch of 360 μm, and designed to simultaneously discharge the red, blue and green phosphor pastes was used, and that the application of all the phosphor pastes was followed by drying at 80° C. for 45 minutes. The evaluation results are shown in Table 1.

Example 10

A phosphor layer was formed as described in Example 8, except that phosphor pastes respectively composed of 50 g of a phosphor powder, 20 g of a binder polymer, 20 g of trimethylolpropane triacrylate, 30 g of a solvent (γ-butyrolactone), 4 g of a dispersing agent and a photo polymerization initiator ("Irgacure 907" produced by Ciba Geigy) and with a viscosity of 0.03 Pa·s (all of red, green and blue) were used.

Subsequently, it was exposed using a photo mask with 1920 open lines with a width of 60 μm formed at a pitch of 150 μm, developed by 0.5 wt % triethanolamine aqueous solution and burned at 500° C. for 30 minutes, to form a fluorescent material layer. The evaluation results are shown in Table 1.

Comparative Example 1

A substrate with electrodes formed at a pitch of 120 μm and with barrier ribs of 30 μm in width and 90 μm in height formed at a pitch of 120 μm was screen-printed with red, green and blue fluorescent pastes using a screen with openings of 80 μm formed at a pitch of 360 μm. The substrate was burned at 460° C. for 15 minutes, to form a phosphor layer. The evaluation results are shown in Table 1.

TABLE 1

Evaluation results of phosphor layers

| | ease of paste application | Coating time (sec) | Thickness of side wall (m) | Thickness of bottom wall (m) | Thickness distribution (m) | Deposition on top ends of barrier ribs | Mixing of colors |
|---|---|---|---|---|---|---|---|
| Example 1 | Good | 280 | 17 | 19 | 3 | Did not occur. | Did not occur. |
| Example 2 | Good | 155 | 19 | 19 | 4 | Did not occur. | Did not occur. |
| Example 3 | Good | 103 | 21 | 20 | 3 | Did not occur. | Did not occur. |
| Example 4 | Good | 24 | 20 | 20 | 3 | Did not occur. | Did not occur. |
| Example 5 | Good | 310 | 18 | 16 | 0 | Did not occur. | Did not occur. |
| Example 6 | Good | 310 | 17 | 17 | 1 | Did not occur. | Did not occur. |
| Example 7 | Good | 330 | 18 | 18 | 3 | Did not occur. | Did not occur. |
| Example 8 | Good | 24 | 20 | 30 | 4 | Did not occur. | Did not occur. |
| Example 9 | Good | 10 | 10 | 40 | 4 | Did not occur. | Did not occur. |
| Example 10 | Good | 24 | 23 | 30 | 6 | Did not occur. | Did not occur. |
| Comparative Example 1 | — | 58 | 8 | 27 | 8 | Occurred. | Occurred. |

INDUSTRIAL APPLICABILITY

Since a highly precise phosphor layer can be simply formed on the highly precise spaces between barrier ribs, a widely-applicable high quality plasma display with a phosphor layer usable as a highly precise plasma display can be obtained. In addition, the plasma display can be produced continuously at a high productivity level industrially advantageously.

The highly precise plasma display can be used widely in the display field for wall mounted television sets and information displays.

The invention claimed is:

1. A. method for producing a plasma display, comprising applying, in stripes between barrier ribs, a phosphor paste containing a phosphor powder and an organic compound onto a substrate having a plurality of the barrier ribs formed thereon, by pressing the phosphor paste continuously at a selected pressure and discharging the phosphor paste from 640 to 2000 outlet holes of an average diameter of 10 μm to 500 μm, contained in a paste applicator positioned above the substrate for red, green or blue phosphor paste such that the phosphor paste 1) continuously flows downwardly from all of the holes at the same time and into all of the spaces to be coated between the barrier ribs during a one time relative movement between the paste applicator and the substrate and 2) is arranged in a pattern wherein adjacent spaces do not contain the same color.

2. A method for producing a plasma display, comprising coating a substrate having a plurality of adjacent barrier ribs, with three phosphor pastes respectively containing a phosphor powder emitting light of red, green or blue as stripes in spaces between said respectively adjacent barrier ribs, by continuously applying a selected pressure to the respective phosphor pastes and discharging the respective phosphor pastes from 640 to 2000 outlet holes of an average diameter of 10 to 500 μm contained in a paste applicator positioned above the substrate for the red, green and blue phosphor pastes such that the phosphor paste continuously flows downwardly from all of the holes for each color of the phosphor paste at the same time and into all of the spaces to be coated between the barrier ribs during a one time relative movement between the paste applicator and the substrate, and heating to form a phosphor layer.

3. An apparatus for producing a plasma display, comprising a paste applicator for applying, in spaces between barrier ribs, a phosphor paste containing a phosphor powder emitting light of red, green or blue by pressing the phosphor paste continuously at a selected pressure and discharging the phosphor paste onto a substrate having a plurality of the barrier ribs formed thereon wherein the paste applicator is provided above the substrate and having 640 to 2000 outlet holes that face the barrier ribs of the substrate such that the phosphor paste continuously flows downwardly into all of the spaces to be coated between the barrier ribs during a one time relapse movement, of an average diameter of 10 to 500 μm for the red, green or blue phosphor paste and a means for moving the substrate and the paste applicator relative to each other such that the phosphor paste is arranged in a pattern wherein adjacent spaces do not contain the same color.

4. An apparatus for producing a plasma display, comprising a paste applicator for applying, in spaces between barrier ribs, three phosphor pastes respectively containing a phosphor powder emitting light of red, green or blue by pressing the phosphor paste continuously at a selected pressure and discharging the respective phosphor pastes onto a substrate having a plurality of the barrier ribs formed thereon, wherein the paste applicator is provided above the substrate and having 640 to 2000 outlet holes that thee die barrier ribs of the substrate such that the respective phosphor pastes continuously flow downwardly into all of the spaces to be coated between the barrier ribs during a one time relative movement, of an average diameter of 10 to 500 μm for the red, green and blue phosphor pastes and a means for moving the substrate and the paste applicator relative to each other.

* * * * *

UNITED STATES PATENT AND TRADEMARK OFFICE

CERTIFICATE OF CORRECTION

PATENT NO. : 7,455,879 B2
APPLICATION NO. : 09/125128
DATED : November 25, 2008
INVENTOR(S) : Iguchi et al.

It is certified that error appears in the above-identified patent and that said Letters Patent is hereby corrected as shown below:

On the Title Page
Item (57) at lines 7, 10,13, and 14, please change “baffler” to -- barrier --.

In Column 2
Bridging lines 21 and 22, please move line 22 to line 21 after “ribs and”; and change “An” to -- an -- after “apparatus”.

In Column 8
At line 38, after “phosphor”, please insert -- can be used --.

In Column 10
At line 34, after “surfaces of”, please insert -- barrier ribs or goes into the cells adjacent to the cells to be coated, color mixing or electric --.

In Column 17
Bridging lines 26 and 27, please delete “of the present invention”.

In Column 18
At line 25, please change “One” to -- one --.

In Column 22
At line 13, please change “applicator” to -- applicator. --; and at line 44, please change “Applicator” to -- applicator --.

In Column 27
At lines 43 to 45, please delete “[. Accordingly, the applicator had 639 intervals between the holes, and the length of the line of holes was 639 xthe pitch of 450 μm, which is 287.550 mm. The]”

UNITED STATES PATENT AND TRADEMARK OFFICE

CERTIFICATE OF CORRECTION

PATENT NO. : 7,455,879 B2
APPLICATION NO. : 09/125128
DATED : November 25, 2008
INVENTOR(S) : Iguchi et al.

It is certified that error appears in the above-identified patent and that said Letters Patent is hereby corrected as shown below:

In Column 30

At line 17, after "time" please change "relapse" to -- relative --; and at line 31, after "holes that", please change "thee die" to -- face the --.

Signed and Sealed this

Twenty-ninth Day of September, 2009

David J. Kappos

David J. Kappos
*Director of the United States Patent and Trademark Office*